US006527610B1

(12) United States Patent
Hornsby et al.

(10) Patent No.: US 6,527,610 B1
(45) Date of Patent: Mar. 4, 2003

(54) WEARABLE INTERACTIVE DIGITAL AMUSEMENT DEVICE

(75) Inventors: Russell Hornsby, St. Louis, MO (US); Christian M. Mouser, Ballwin, MO (US); Jason E. Emde, St. Louis, MO (US)

(73) Assignee: Trendmasters, Inc., St. Louis, MO (US)

( * ) Notice: Subject to any disclaimer, the term of this patent is extended or adjusted under 35 U.S.C. 154(b) by 0 days.

(21) Appl. No.: 09/462,709

(22) PCT Filed: Aug. 25, 1999

(86) PCT No.: PCT/US99/19397

§ 371 (c)(1),
(2), (4) Date: Jan. 11, 2000

(87) PCT Pub. No.: WO00/10662

PCT Pub. Date: Mar. 2, 2000

Related U.S. Application Data

(63) Continuation-in-part of application No. 29/088,590, filed on May 28, 1998.
(60) Provisional application No. 60/097,871, filed on Aug. 26, 1998.

(51) Int. Cl.[7] ..... A63H 3/28
(52) U.S. Cl. ..... 446/175; 463/48; 368/10
(58) Field of Search ..... 463/1, 31, 35, 463/37, 36, 46, 47, 48; 368/3, 10; 381/51; 446/175

(56) References Cited

U.S. PATENT DOCUMENTS

| | | | | |
|---|---|---|---|---|
| 4,158,285 A | | 6/1979 | Heinsen et al. | |
| 4,314,423 A | | 2/1982 | Lipsitz et al. | |
| 4,379,640 A | | 4/1983 | Inoue | |
| 4,395,134 A | * | 7/1983 | Luce | 368/3 |
| 4,424,967 A | * | 1/1984 | Yokoi et al. | 368/3 |
| 4,672,541 A | | 6/1987 | Bromley et al. | |
| 4,696,653 A | * | 9/1987 | McKeefery | 446/175 |
| 4,799,171 A | * | 1/1989 | Cummings | 381/51 |
| 4,802,879 A | | 2/1989 | Rissman et al. | |
| 4,815,733 A | | 3/1989 | Yokoi | |
| 4,923,428 A | * | 5/1990 | Curran | 446/175 |
| 5,002,511 A | | 3/1991 | Maki | |
| 5,029,214 A | * | 7/1991 | Hollander | 381/51 |
| 5,083,968 A | | 1/1992 | Hart | |
| 5,184,830 A | | 2/1993 | Okada et al. | |
| 5,265,009 A | | 11/1993 | Colavita | |
| 5,572,646 A | | 11/1996 | Kawai | |
| 5,967,516 A | * | 10/1999 | Phillips | 368/3 |
| 5,971,855 A | | 10/1999 | Ng | |

OTHER PUBLICATIONS

Tamagotchi, 1996–1997.*

Pokemon, 1995, 1998.*

* cited by examiner

*Primary Examiner*—Michael O'Neill
(74) *Attorney, Agent, or Firm*—Dorsey & Whitney LLP

(57) ABSTRACT

The present invention provides an interactive electronic, digital device (16), largely an amusement device, including a display (20) of animated characters with sound effects housed in a unit (19) to be worn or carried by a wearer or user. The characters and sound effects are interactive with the wearer or user, for example, in response to wearer or user movement or selective actuation (e.g., through a button or touch panel). The interactivity could also be responsive to ambient sounds (e.g., music or voice) or movement.

14 Claims, 19 Drawing Sheets

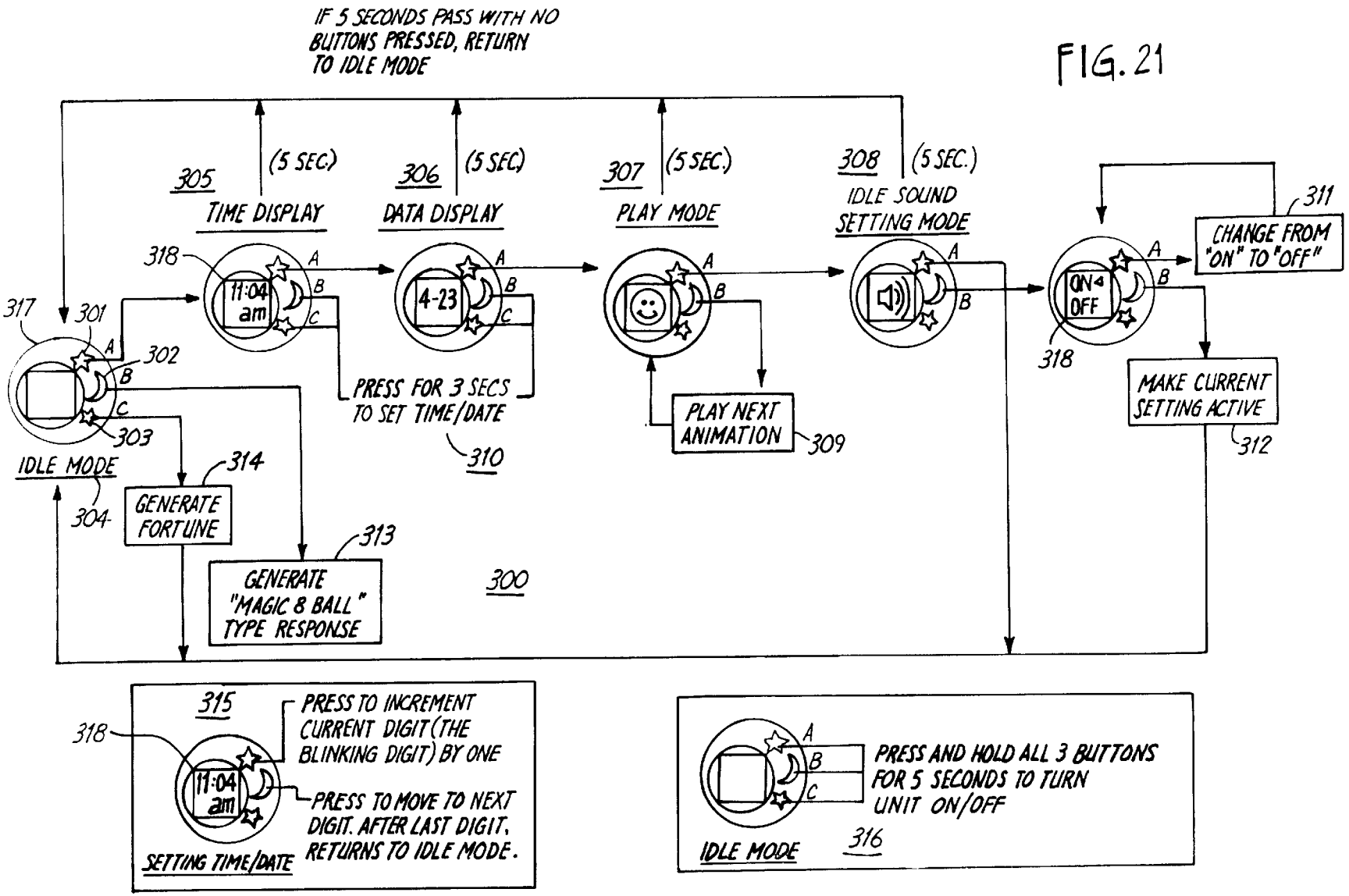
FIG. 21
IF 5 SECONDS PASS WITH NO BUTTONS PRESSED, RETURN TO IDLE MODE
(5 SEC.)
305
TIME DISPLAY
(5 SEC.)
306
DATA DISPLAY
(5 SEC.)
307
PLAY MODE
(5 SEC.)
308
IDLE SOUND SETTING MODE
311
CHANGE FROM "ON" TO "OFF"
312
MAKE CURRENT SETTING ACTIVE
309
PLAY NEXT ANIMATION
310
PRESS FOR 3 SECS TO SET TIME/DATE
313
GENERATE "MAGIC 8 BALL" TYPE RESPONSE
314
GENERATE FORTUNE
300
IDLE MODE
304
301
302
303
317
318
11:04 am
4-23
ON OFF
315
PRESS TO INCREMENT CURRENT DIGIT (THE BLINKING DIGIT) BY ONE
PRESS TO MOVE TO NEXT DIGIT. AFTER LAST DIGIT, RETURNS TO IDLE MODE.
SETTING TIME/DATE
316
PRESS AND HOLD ALL 3 BUTTONS FOR 5 SECONDS TO TURN UNIT ON/OFF
IDLE MODE

WEARABLE INTERACTIVE DIGITAL AMUSEMENT DEVICE

This application is a continuation-in-part of co-pending U.S. design patent application Ser. No. 29/088,590, filed May 28, 1998, and claims the priority of that application and U.S. provisional application Ser. No. 60/097,871, filed Aug. 26, 1998.

BACKGROUND

The present invention relates to amusement devices and, more particularly, to an electronic, substantially digital, interactive amusement device designed to be worn or carried by a user.

Amusement devices have, of course, long been known. From simple inert objects designed to be handled by a person or passed among people, they have advanced to objects having manipulable mechanical features and, more recently, to objects having electronic features or a combination of mechanical and electronic features. Dolls or figurines provide one good example of this evolution, changing from passive representations of infants to currently available dolls which might include not only positionable limbs and changeable facial expressions, but also sound producing electronic systems.

Currently available amusement devices may incorporate digital technology similar to that used in other digital devices such as calculators. For example, an interactive wristwatch calculator such as that disclosed in U.S. Pat. No. 4,158,285 (Heinsen et al.) uses electronic, microprocessor based technology, as does the hand-held video game image-projecting and control apparatus disclosed in U.S. Pat. No. 4,976,429 (Nagel), wherein a user holds a housing with arms carrying control elements for interactive control of a video game.

One recent development in electronic amusement devices is "virtual toys" such as the "Tamagotchi" toy made by the Bandai Company Ltd. Other manufacturers of such toys include Casio, Sega and Nintendo. By way of example, "Tamagotchi" is a small electronic device usually hung on a necklace or key ring. It includes a housing and a display of an animated chick. The user has to "take care" of the chick by inputting signals or responding to the display, or the display will disappear. A similar toy is the "GigaPound Pet" by Tiger Electronics. This toy provides digitally produced animated characters (dogs) and, while the toy is similar to others of the genre, it produces and responds to sounds. In use, when initiated, the user sets a clock, then chooses a character. Button inputs are used to scroll and choose. A choice results in a display and sound, and other choices, input opportunities and results follow.

While these amusement devices represent advances, there is room for improvement. In particular, there is a need for an amusement device which increases the appeal and interactivity of such devices by, for example, appearing to spontaneously produce sounds or visual effects with or without intentional input from the user or observer which provoke or require a response from a person observing the device.

SUMMARY

In one embodiment, the present invention is an interactive electronic device, largely an amusement device and largely digital, including a display of animated characters with sound effects housed in a unit to be worn or carried by a wearer or user. The characters and sound effects are interactive with the wearer or user, for example, in response to wearer or user movement or selective actuation (e.g., though a button or touch panel). The interactivity could also be generated by or be responsive to ambient conditions such as sounds (e.g., music or voice), nearby movement, temperature, light level or other conditions or situations.

In one embodiment, the invention may take the form of a wristwatch like device and, in other embodiments, the device may take the form of a pendant, locket, writing instrument or other object.

In one embodiment, the amusement device comprises an interactive system, in turn comprising an electronic system for use with a video monitor or display and an audio component to drive, actuate and control the display and audio components for displaying images and broadcasting sound, wherein a user of the system may interact with the system, and a software controller for carrying out the display on the monitor and the broadcast of sound in accordance with a software program stored in the software controller and in accordance with certain selected input data supplied by the user and certain additional input data stored in another system memory, wherein said certain additional input data is accessed by the software controller in response to an ambient condition.

The interactive device of the present invention provides and encompasses a method for controlling operation of the device comprising providing a visual output on a display, providing an audio output on an audio output device, receiving input from an input device, and controlling the display and the audio output device based on received input. The input device may receive input by being manipulated physically and/or intentionally, or it may receive input comprising an ambient condition and, in response to the input, the method comprises a first mode providing the visual output and a second mode providing the audio output.

An advantage of the amusement device of the present invention is that it increases the appeal and interactivity of such devices by, for example, appearing to spontaneously produce sounds or visual effects with or without intentional input from the user or observer which provoke or require a response from a person observing the device, as well as providing functions such as time/date information.

In some embodiments, the present invention may include a housing taking a form similar to a commonplace object such as a wristwatch, pendent, fob or a writing instrument.

Other features and advantages of the amusement device and method of the present invention will become more fully apparent and understood with reference to the following description and drawings, and the appended claims.

BRIEF DESCRIPTION OF THE DRAWINGS

FIG. 21 is a flow diagram illustrating operation of another embodiment of an interactive digital amusement device.

DESCRIPTION

The accompanying Figures depict embodiments of the amusement device and method of the present invention, and features, components and the operation thereof. With regard to means for fastening, mounting, attaching or connecting the components of the present invention to form the device as a whole, unless specifically described otherwise, such means are intended to encompass conventional fasteners such as machine screws, machine threads, seals, snap rings, clamps, rivets, nuts and bolts, toggles, pins and the like. Components may also be connected adhesively, by snap or friction fitting, or by welding or deformation, if appropriate. The electronic portions of the device may use conventional, commercially available electronic components, connectors and devices such as suitable wiring, connectors, printed circuit boards, microchips, speakers, lights, liquid crystal displays, audio components, inputs, outputs and the like. Unless specifically otherwise disclosed or taught, materials for making components of the present invention may be selected from appropriate materials such as metal, metallic alloys, natural or synthetic materials, plastics and the like, and appropriate manufacturing, assembly or production methods including casting, extruding, molding and machining and the like may be used.

Any references to front and back, right and left, top and bottom, upper and lower, and horizontal and vertical are intended for convenience of description, not to limit the present invention or its components to any one positional or spacial orientation.

Figure 1:
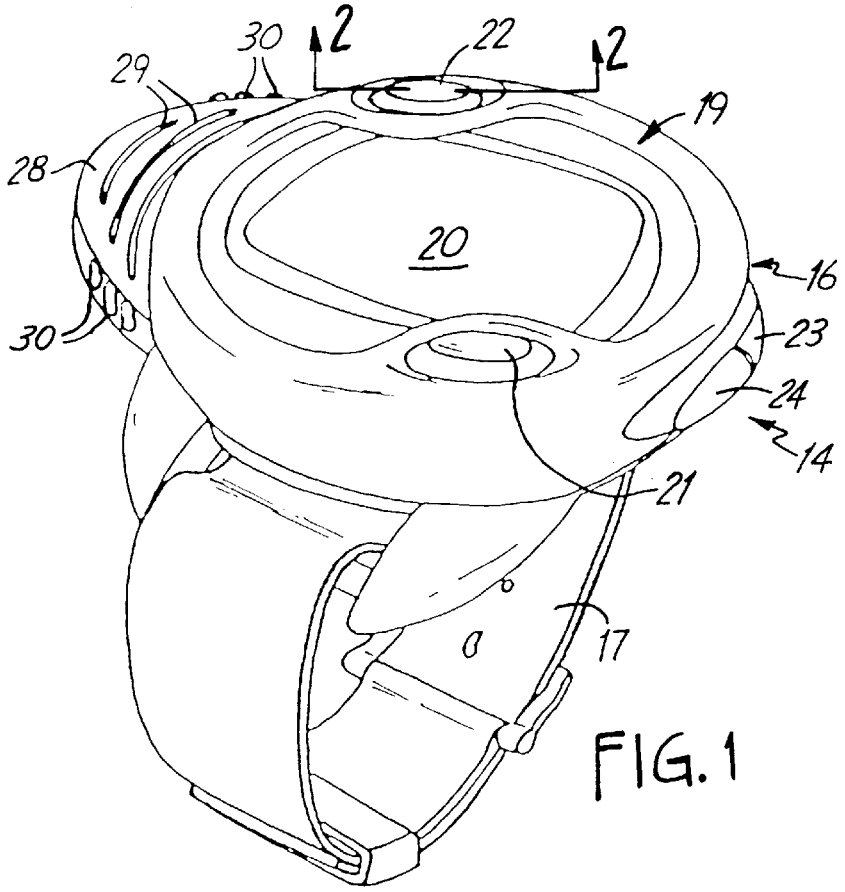
FIG. 1 depicts one embodiment of the amusement device of the present invention.

FIG. 1 depicts one embodiment of the present invention, an electronic amusement device 14 taking a form similar to a wristwatch. The device 14 includes a body 16 releaseably mounted on or coupled to a band, or bands, 17 of flexible material for encircling a wearer's wrist.

The body 16 (which may be formed from a suitable plastic or plastic mixture such as a polycarbonate-ABS blend) has a presentation display face 19, which may carry a decal type screen or film for shaping or coloring a displayed image, includes a visual display area 20 which is capable of displaying changeable display images. The display images may include a variety of virtual characters, patterns and/or other information. FIG. 1 shows a presentation face 19 with a single display area 20, but more than one display area or display screen, or a split display, may be used as well. The display 20 is advantageously a liquid crystal display having a selected format and size such as 32×32, 64×64, 80×80, 100×64, etc., and it may have color capability and integrated backlights for added viewing ease and clarity. Such displays are used in recent electronic display devices and computers, and are commercially available in a variety of types and sizes from several manufacturers. The exact nature and size of the display area 20 can vary and alternative types of displays and future display technologies will likely serve the intended purposes of allowing a user or wearer of the present invention to participate in interactive video displays.

Figure 2:
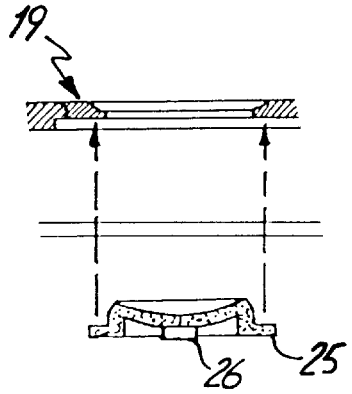
FIG. 2 is a cross-sectional view taken along line 2—2 of FIG. 1

Generally at or adjacent to the peripheral edge of the presentation face 19, the device 14 includes inputs or control keys, switches or buttons 21, 22. On the peripheral side edge of the face 19, the device carries a mode button 23 and an immediately adjacent select button 24. Any of these buttons may be assigned a desired function or functions, and more than one function may be accomplished by a single button, for example, mode and select functions may be combined in a single button. Any of these controls or input button may be selected from a wide variety of commercially available buttons or keys, such as touch keys, used to provide electrical control signals, and one or more of the selected form of input key may be assigned to additional functions, such as in changeable soft key assignments during the programming or setup of the system. One form of suitable button, and the fitting thereof to the device 14, is depicted in FIG. 2. One material suitable for the button is a rubber material, such as santoprene. The selected button material may be formed with a lip 25 which may be preferably adhesively secured to the face 19 around an opening therein. The button material overlies a suitable contact, for example a graphite contact 26.

The device includes a speaker housing or grill 28 on its peripheral edge, opposite the mode and select buttons. The speaker grill is provided with openings or vents 29 suitable for emitting sound, and its sides may be provided with bumps 30 or texture to facilitate manipulating the device 19 as explained below (with reference to FIGS. 8*a–c* and 9*a–c*). The vents may be covered with a thin film of Mylar or other suitable material sealed in place to maintain the watertightness of the device 14.

Figure 3:
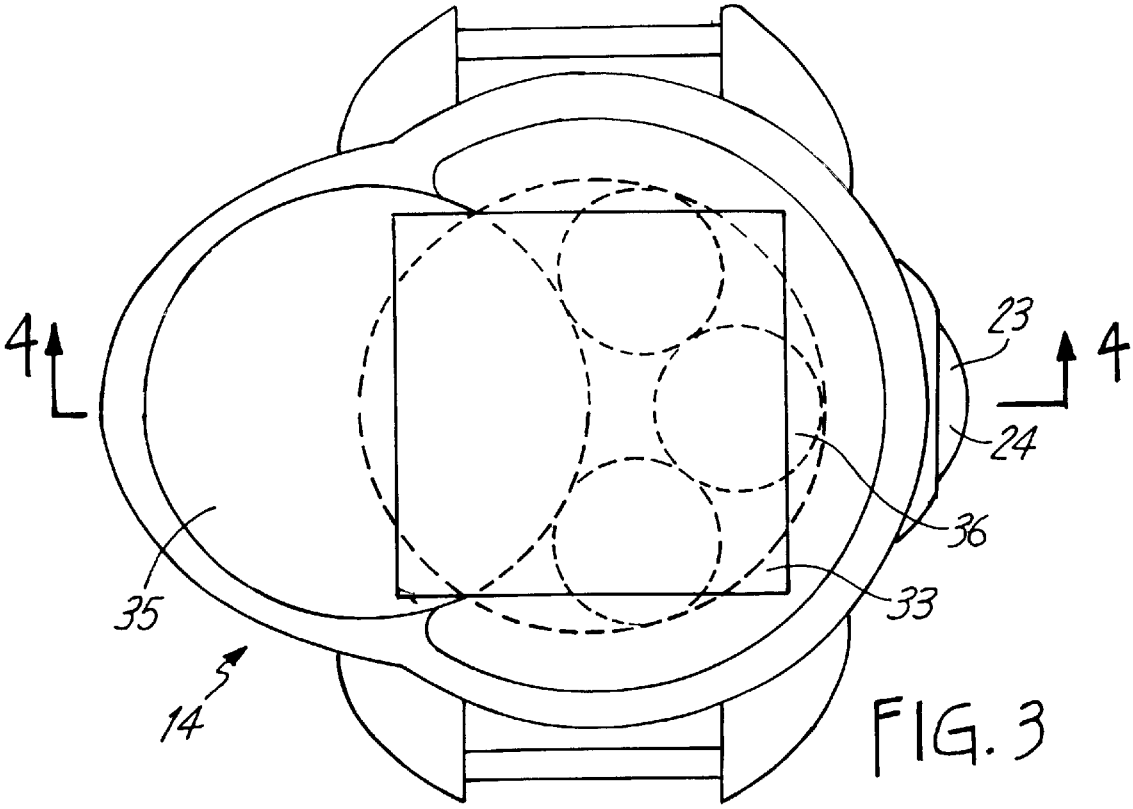
FIG. 3 is a plan view of the invention with portions removed for clarity.
Figure 4:
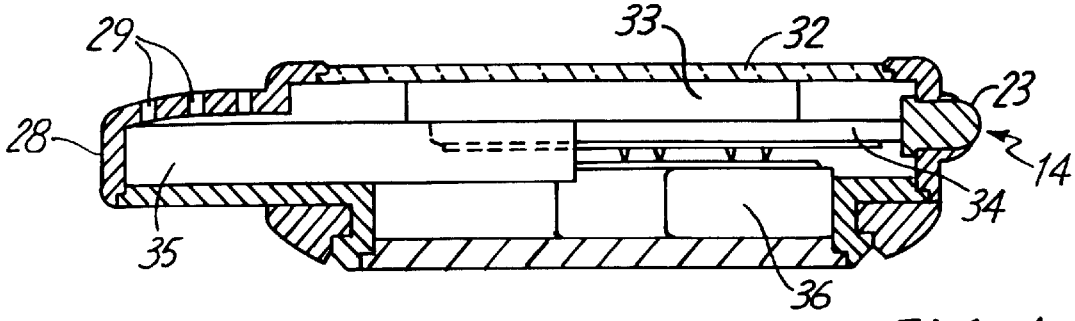
FIG. 4 is a cross-sectional view taken along line 4—4 of FIG. 3.
Figure 5:
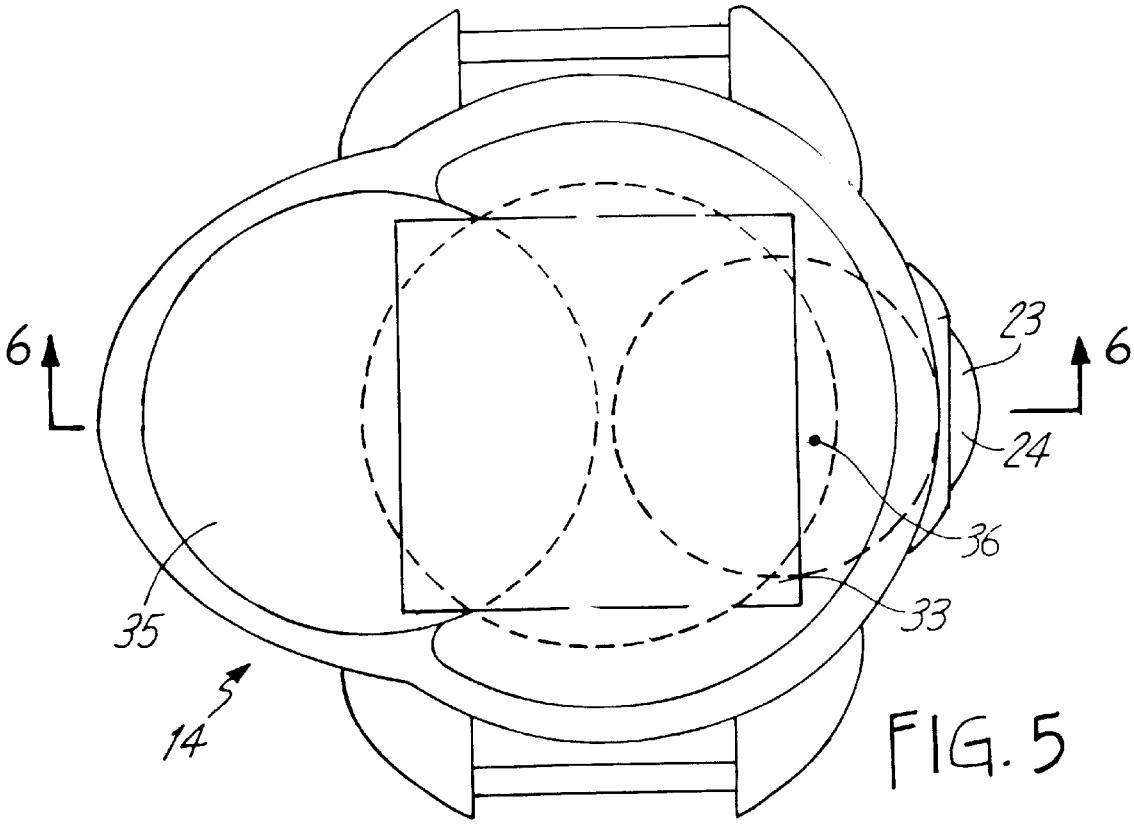
FIG. 5 is a plan view of another embodiment of the invention with portions removed for clarity.
Figure 6:
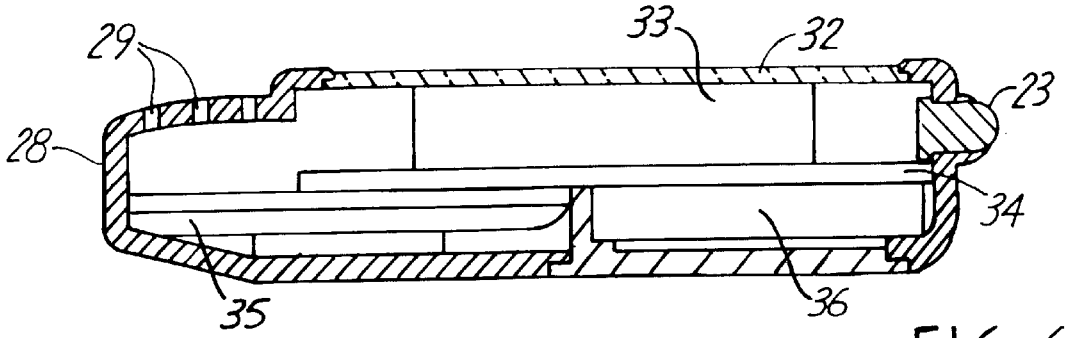
FIG. 6 is a cross-sectional view taken along line 6—6 of FIG. 5.
Figure 7:
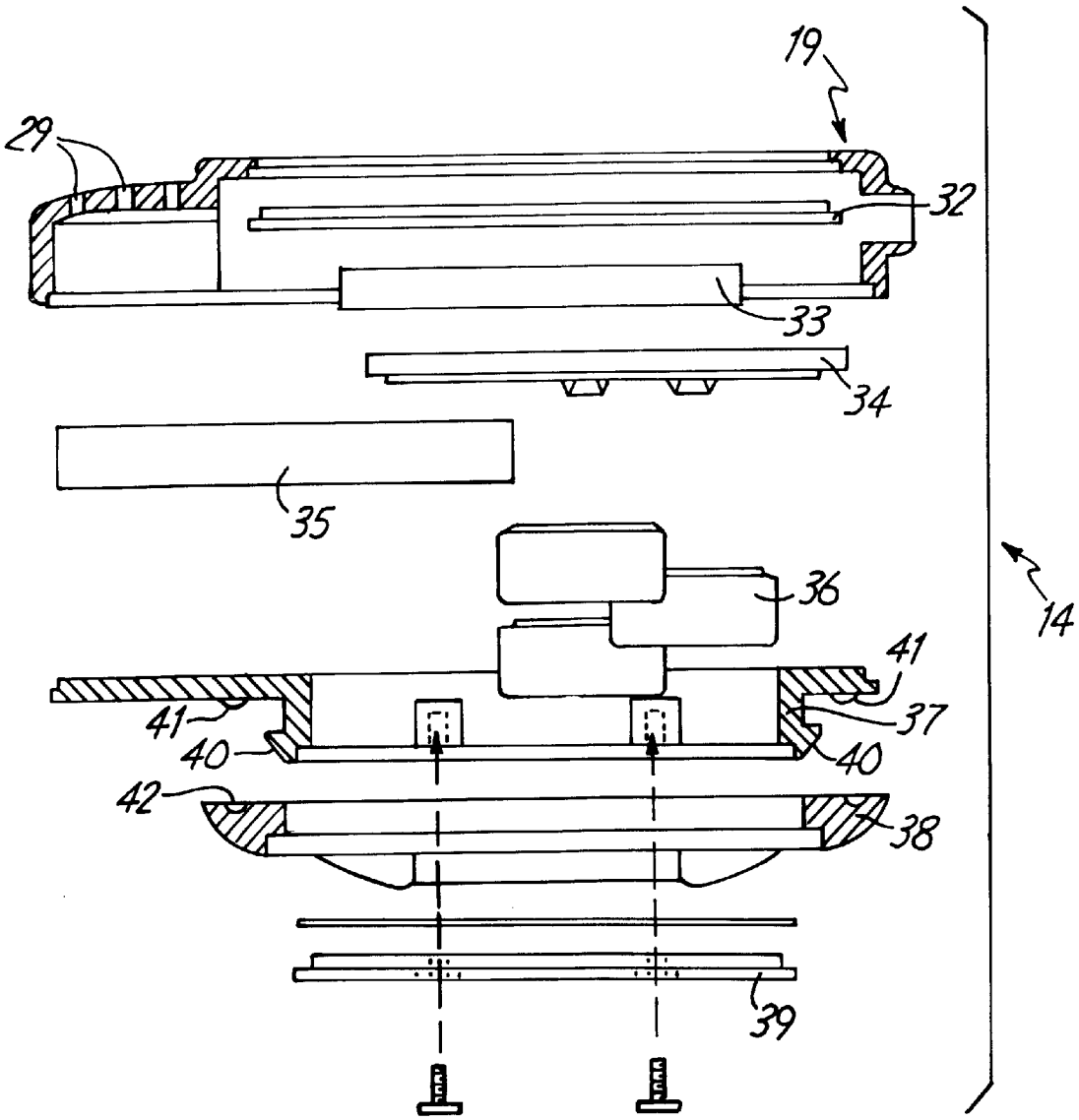
FIG. 7 is an exploded assembly view of the embodiment of FIG. 1.
Figure 8A:
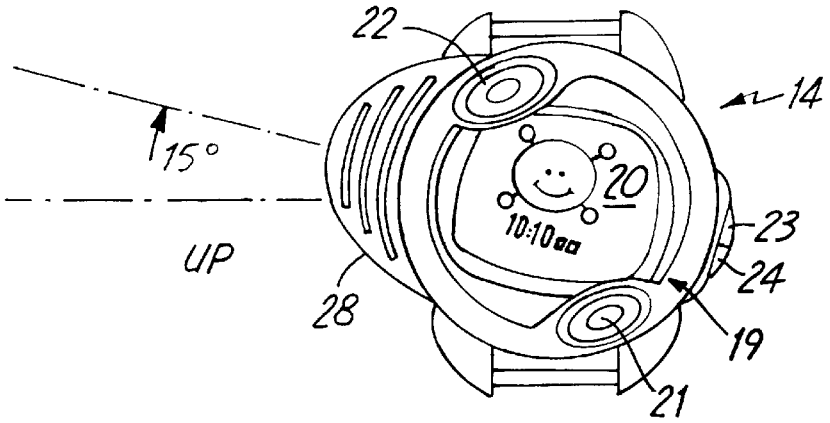
FIGS. 8*a–c* depicts one operation of the present invention.
Figure 8B:
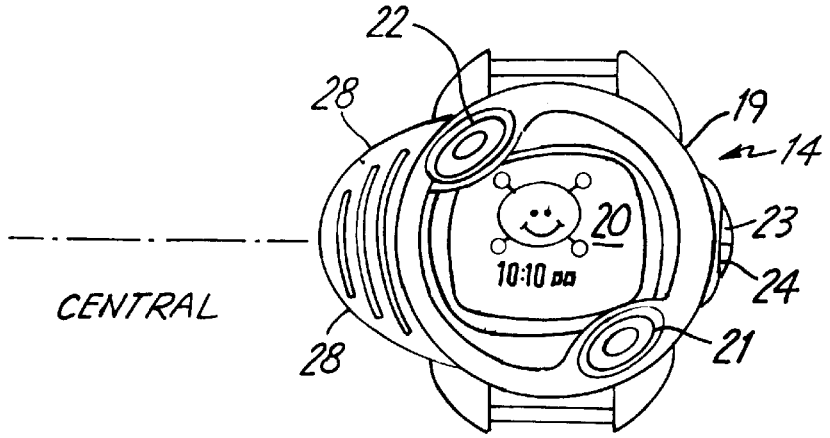
Figure 8C:
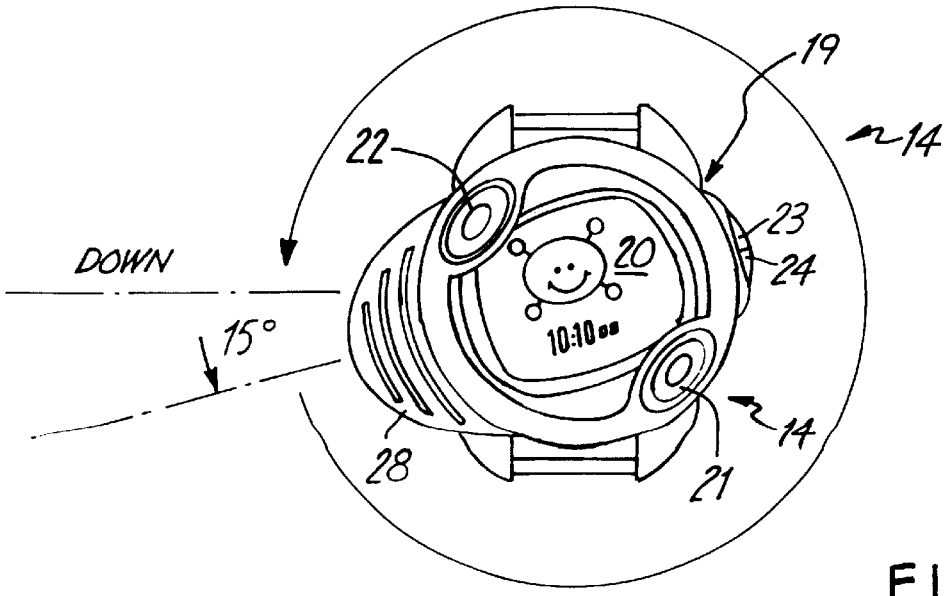
Figure 9A:
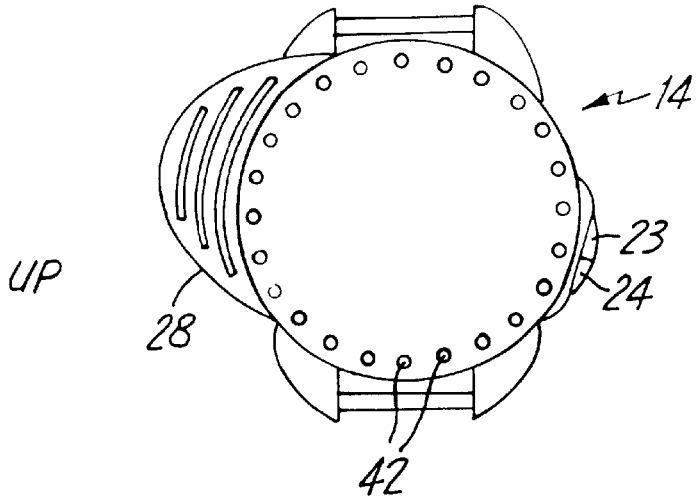
FIGS. 9*a–c* depicts the operation depicted in FIGS. 8*a–c*, with the face of the device removed for clarity.
Figure 9B:
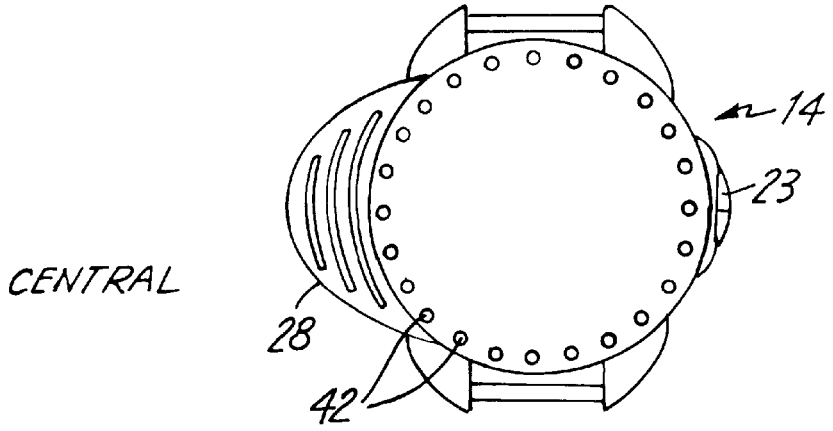
Figure 9C:
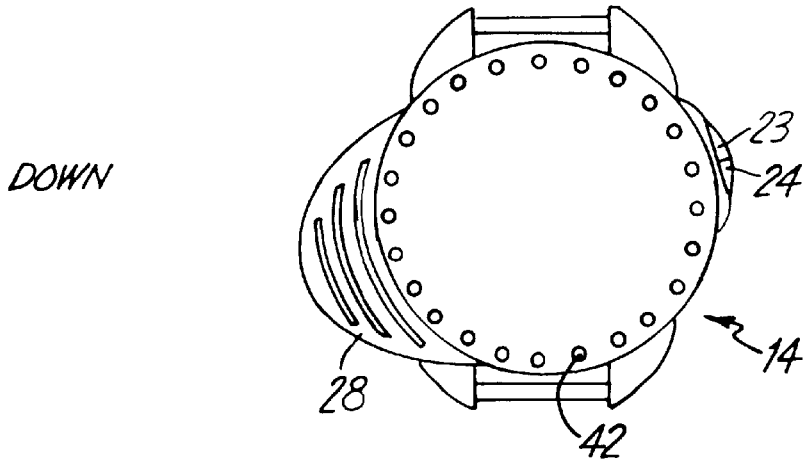

FIG. 7 is an exploded assembly view of one embodiment of the device 14, and depicts that the device includes the top presentation face 19, a generally or substantially clear and scratch resistant lens 32 (polycarbonate is a suitable for forming the lens), a liquid crystal display 33 generally under the lens, and integrated circuit board (the controller, see below) 34, a suitable speaker 35, such as a 28 mm speaker, an appropriate number of batteries 36 for providing a power source, a face bottom 37, a base 38, a battery cover 39 which may be sealed by a suitable O-ring type seal or gasket and is connected to the face bottom by suitable screws. This generally sandwich-like assembly is joined or coupled by the joining the face top 19 and face bottom 37, then snap fitting the face assembly, i.e., the top and bottom containing the lens, etc., to the base 38. The "arrowhead" snap fitting 40 of the face bottom 37 enables the firm, yet rotational or spinning movement of the face assembly within or on the base 38. Between the face assembly and the base 38, generally along or adjacent to the peripheral edges thereof, the device 14 may be provided with a plurality of snap bumps 41 and complimentary snap recesses 42 in a detent like arrangement. FIGS. 3 and 4 depict the basic layout and placement of the components when assembled. Similarly, FIGS. 5 and 6 depict another basic layout wherein the three button batteries have been replaced by a single battery cell, for example a lithium cell.

In one embodiment, the function of the buttons or inputs may be outlined as follows. The mode button 23 toggles through available programs and features, and the select button 24 selects items. Input button 22 is a "hot" key, comprising the start and stop button, the input for controlling a main game, the input for triggering a character to tell the time and for resetting the device. Input button 21 is also a hot key or input, and controls the playing of another game, clearing the device and resetting. These functions are exemplary, and additional functions may be provided and/or assigned or reassigned to the inputs or selected combinations thereof, and additional input buttons may be provided as desired. The enumerated functions will be further explained and understood in conjunction with FIGS. 20–23 which depict operational flows of representative embodiments of the present invention.

The movement of the face assembly is depicted in FIGS. 8*a–c* and 9*a–c*. These two sets of Figures are substantially similar, but in FIGS. 9*a–c*, the face has been removed for clarity. The 360 degree spinning or rotational movement of the face assembly may be controlled incrementally, for example in 15 degree increments, by the snap bumps and recesses. The face assembly can be moved in either direction for user or wearer convenience, comfort and/or amusement.

Figure 10:
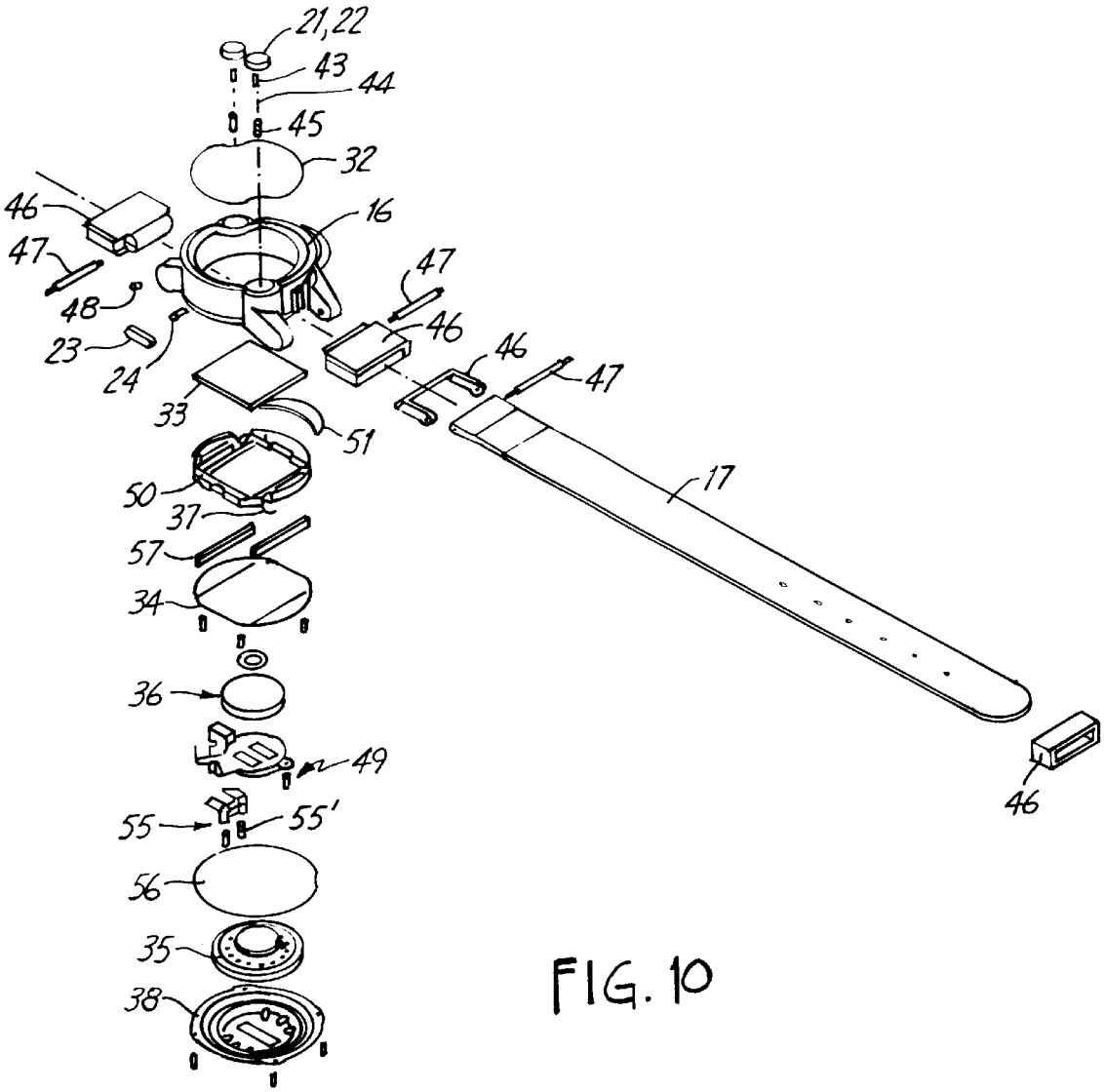
FIG. 10 is an exploded assembly view of one embodiment of the invention.
Figure 11:
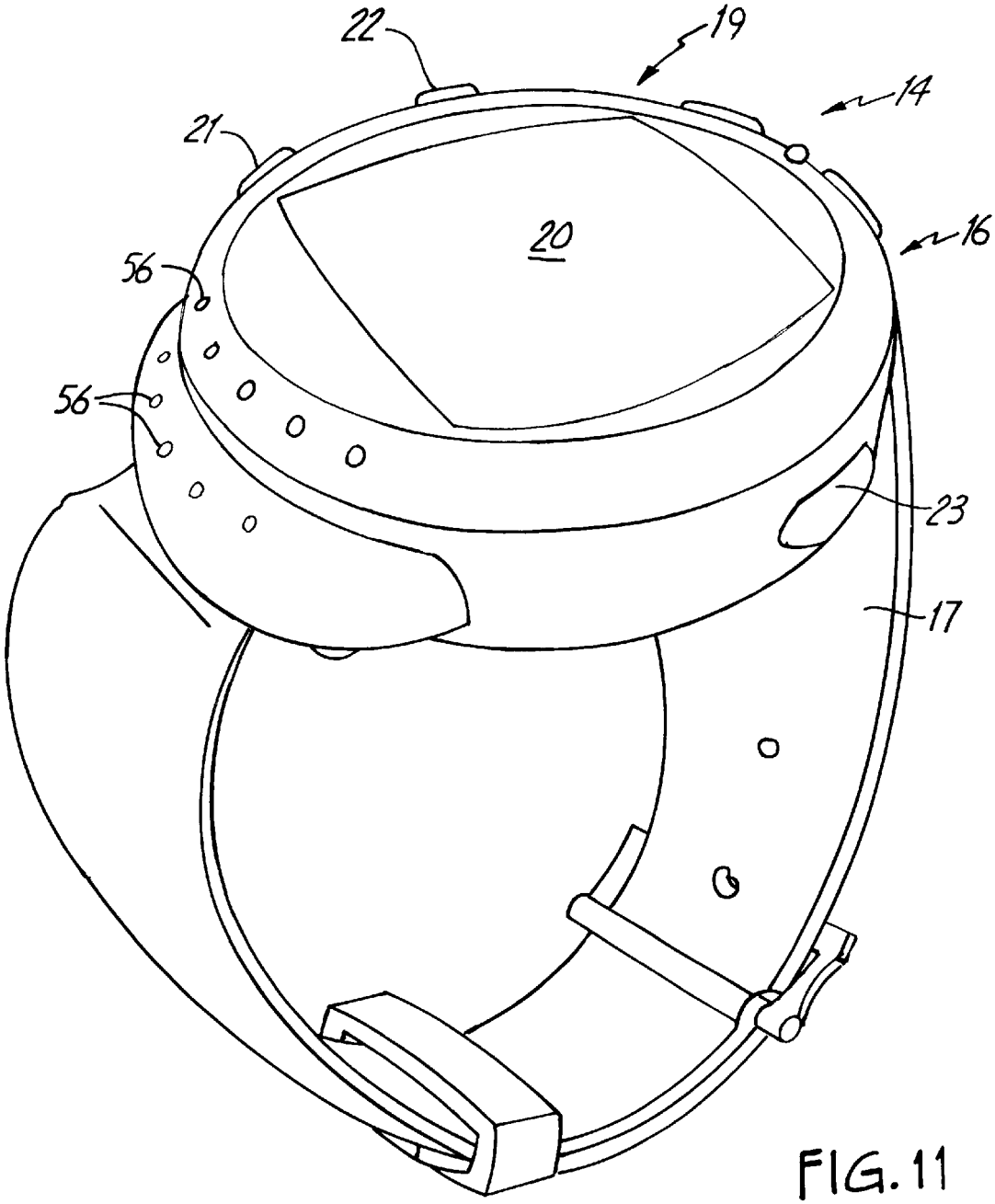
FIG. 11 depicts another embodiment of the present invention.
Figure 12:
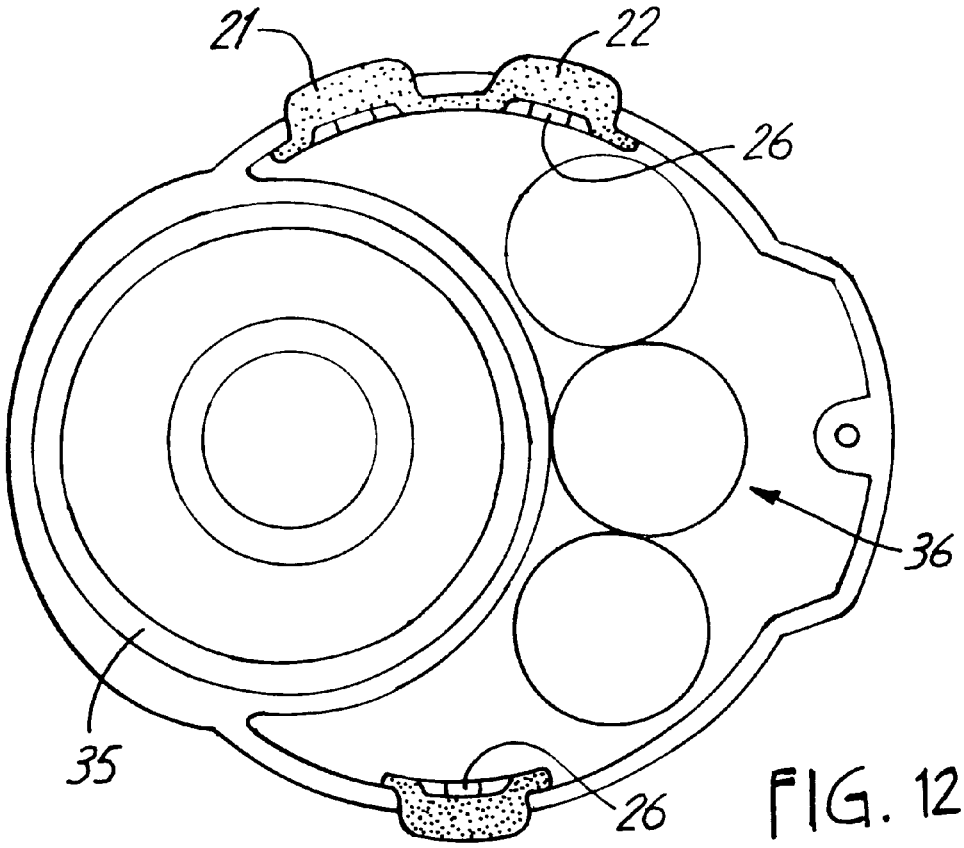
FIG. 12 is a plan view of the embodiment of FIG. 11, with portions removed for clarity.

FIG. 10 depicts an exploded assembly of one embodiment of the invention. Features in common or similar to features depicted in FIGS. 1–9*a–c* are commonly referenced. The depicted assembly includes an input assembly including buttons 21, 22, suitable pushers 43, O-ring type seals 44 and springs 45. A lens 32 is received in the body 16. Suitable buckles 46 and pins 47 are used to couple the device 14 to the band 17. A reset key 48 is located on the body 16 and sealed by an appropriate seal, for example, an O-ring type seal. Additional input/control buttons 23, 24 are also located at the side of the body 16. An LCD 33 is received in the device 14, and operably supported therein by a LCD frame member 50 and connectors 51. A back cover 37 is provided. A microprocessor printed circuit board 34 is operably mounted, as is a battery assembly 36. An operating mechanism, such as spring/contact assembly 55, including an appropriate number of springs 55' and a spring guiding clip 49, is provided for making or completing a solder-less speaker electrical connection between the speaker 35 and the printed circuit board 34. The clip is coupled to the printed circuit board, and includes a movable generally center portion so a user can conveniently replace the battery 36 without detaching the clip 49 from the board 34. The speaker 35 is set and mounted within the back cover 38, which is sealed by a suitable fixed ring 56. Suitable screws, threads or other connective structures or methods are provided as necessary to join components and the assembly as a whole.

Figure 13:
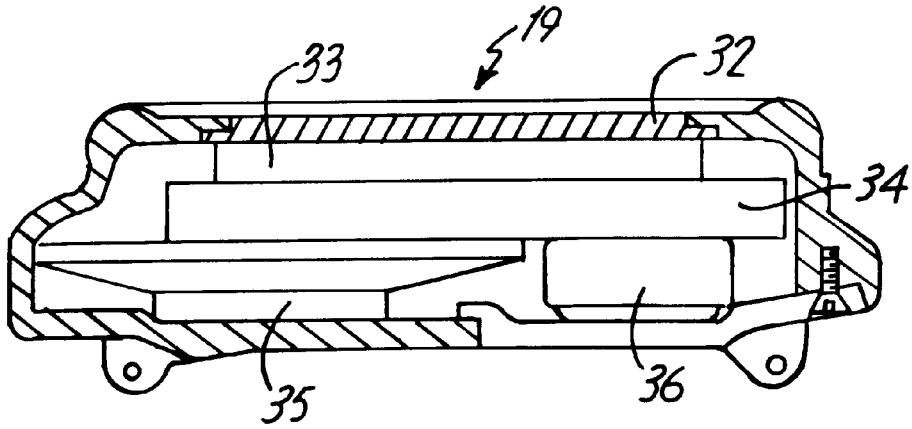
FIG. 13 is a cross-sectional view of the embodiment of FIG. 11.
Figure 14:
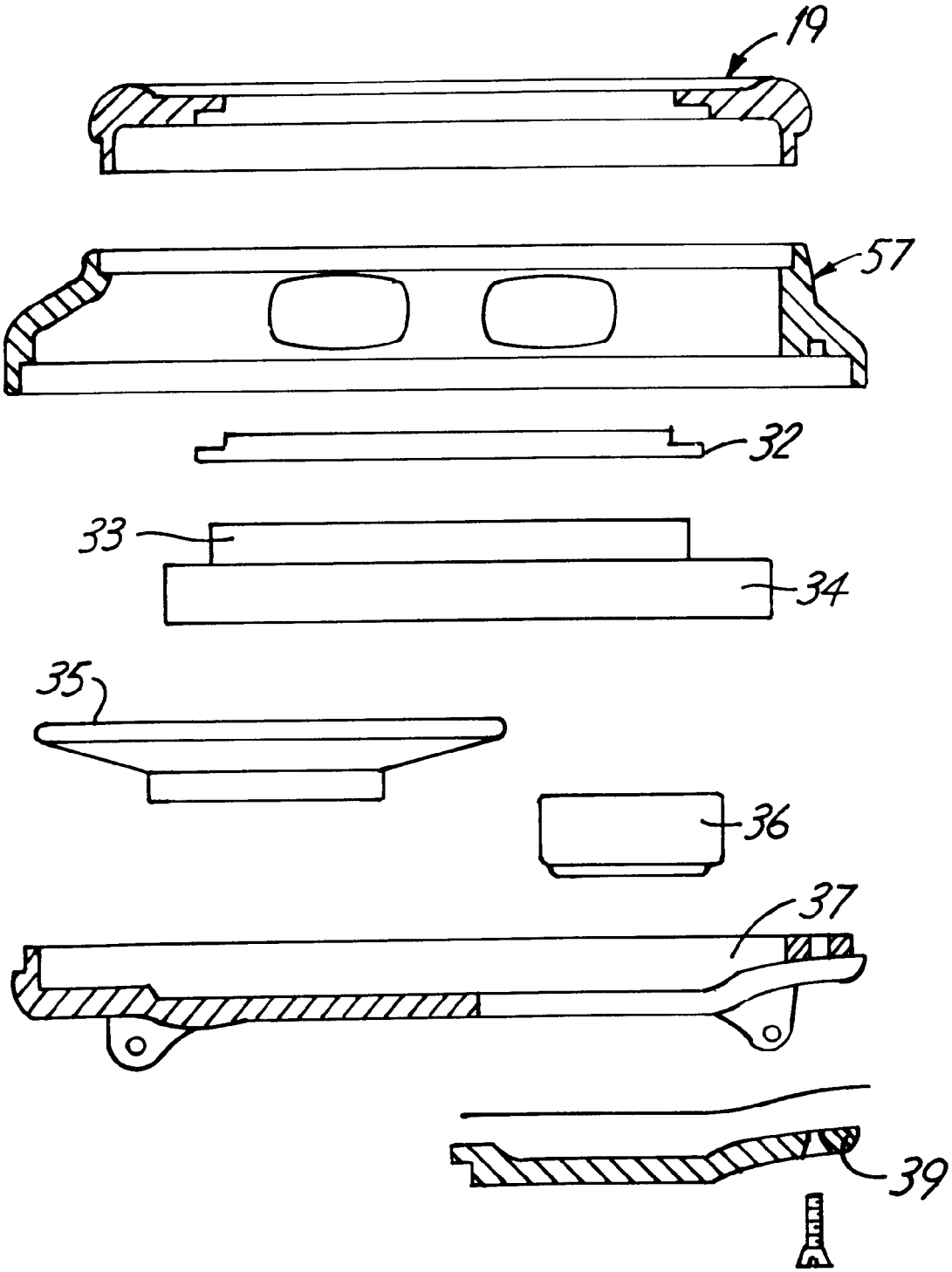
FIG. 14 is an exploded assembly view of the embodiment of FIG. 11.

Another embodiment of the present invention is depicted in FIGS. 11–14. Features in common or similar to features depicted in FIGS. 1–9*a–c* are commonly referenced, and the embodiment of FIGS. 11–14 is generally similar. It includes a body 16 mounted on a band 17, and a presentation face 19, with a display 20. Input buttons 21, 22 are provided as necessary to accomplish desired functions, as is an enter button 23. The button structures or assemblies may be substantially similar to those described above. In this embodiment, the body 16 incorporates sound outlet openings 56. FIG. 14 is an exploded assembly view of this embodiment, which comprises a top presentation face 19, a main body member 57, a generally or substantially clear and scratch resistant lens 32, a liquid crystal display screen 33 generally under the lens, and integrated circuit board 34 (the controller, see below), a suitable speaker 35, an appropriate number of batteries 36 for providing a power source, a bottom 37, and a battery cover 39. These components may be joined by suitable connectors, such as screws or threads. It should be appreciated that this embodiment provides a fixed presentation face 19. FIGS. 13 and 14 depict one layout or arrangement of the components when assembled.

Figure 15:
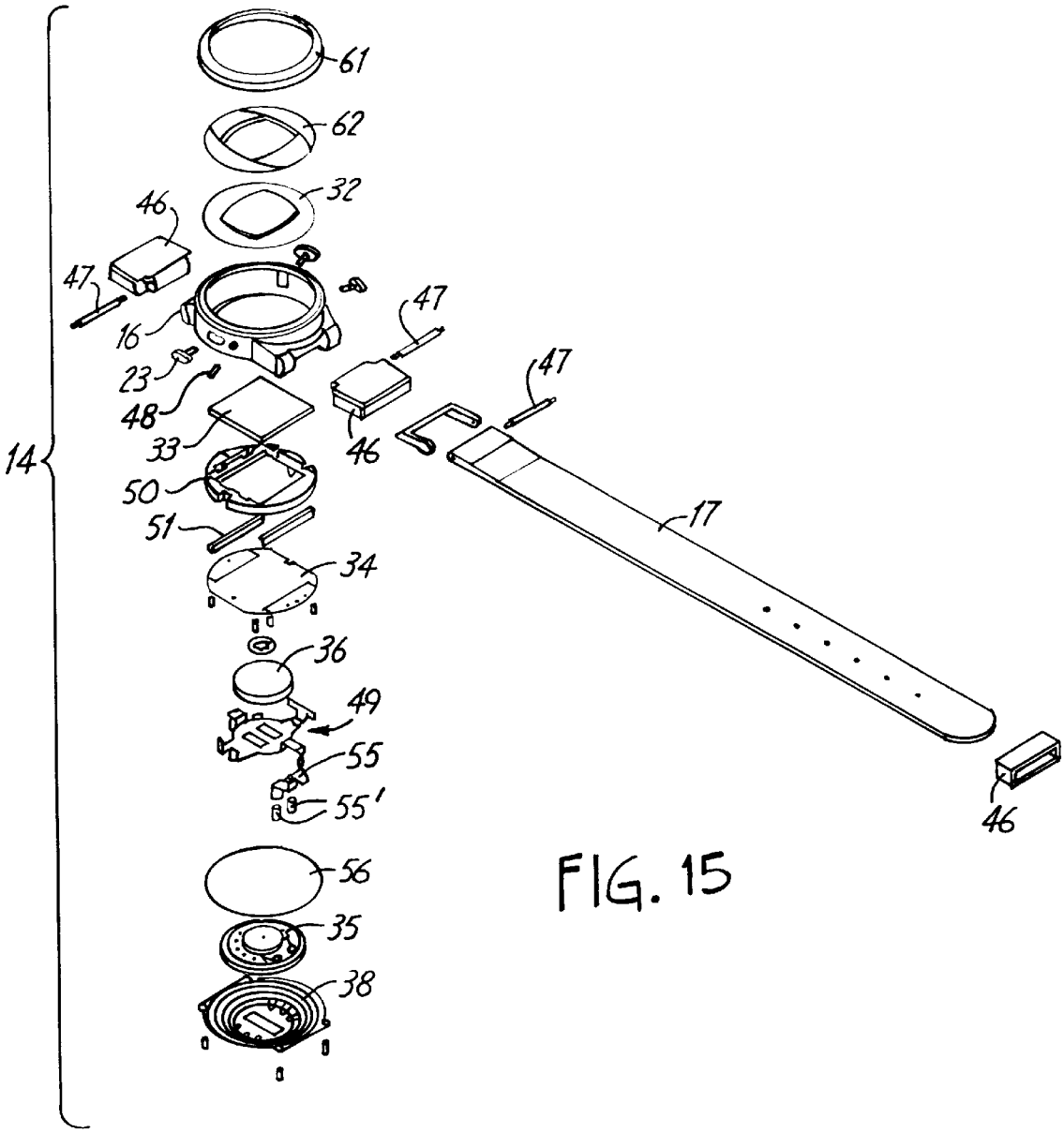
FIG. 15 is an exploded assembly view of another embodiment of the present invention.

FIG. 15 is an exploded assembly depicting an embodiment substantially similar to the embodiments depicted and described with reference to FIGS. 11–14, and generally similar to the embodiment depicted in FIGS. 1–9*a–c*. Generally common or similar features are commonly referenced. The depicted assembly includes inputs or controls 21, 22, 23 which may be similar to those described above. A lens 32 is received in the body 16, which is closed at the presentation face by a ring 61 and face plate 62. Suitable buckles 46 and pins 47 are used to couple the device 14 to the band 17. A reset key 48 is located on the body 16. A liquid crystal display ("LCD") 33 is received in the device 14, and operably supported therein by a LCD frame member 50 and connectors 51. A microprocessor printed circuit board 34 is operably mounted, as is a battery 36. An operating mechanism, such as spring/contact assembly 55, including an appropriate number of springs 55' and a spring guiding clip 49, is provided for making or completing a solder-less speaker electrical connection between the speaker 35 and the printed circuit board 34. The speaker 35 is set and mounted within the back cover 38, which is sealed by a suitable fixed ring 56. Suitable screws, threads or other connective structures or methods are provided as necessary to join components and the assembly as a whole.

Figure 16:
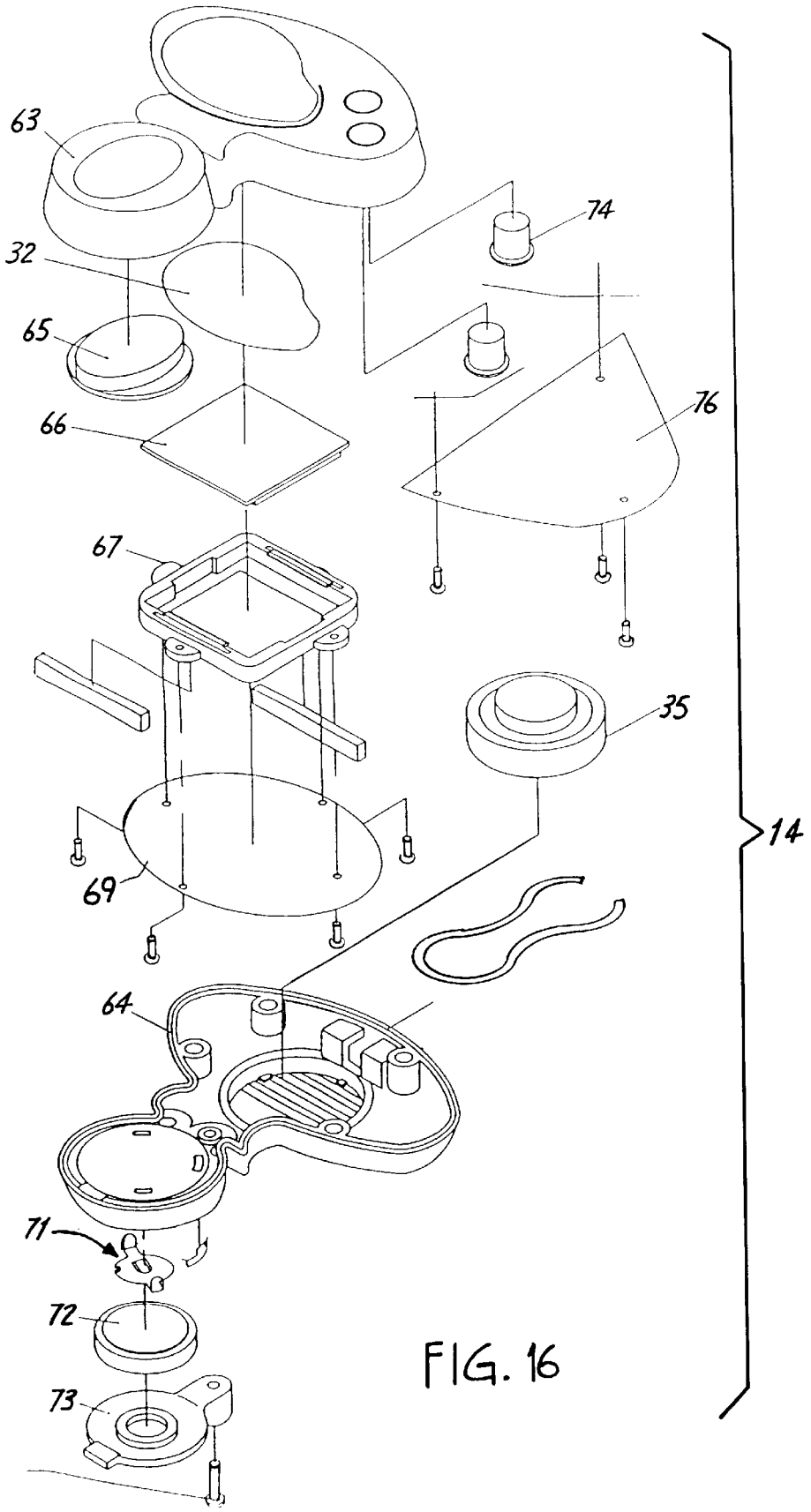
FIG. 16 is an exploded assembly view of another embodiment of the present invention.

FIG. 16 is an exploded assembly view depicting another embodiment of the present invention wherein the invention takes the form of a pendent or broach. This embodiment comprises a front case member 63 and a rear case member 64 joined to form a generally closed housing. The housing includes an opening which is occupied by a lens 32, and another opening occupied by a touch pad input 65. It houses a LCD 66, supported by an LCD frame 67. A first printed circuit board controller 69 is received in the housing. Suitable contacts 71 are provided to link operable components, and a battery or battery assembly 72 is provided for power and enclosed by a battery cover 73. Function or input buttons, such as button 74, are provided, as are openings suitable for receiving the buttons. A second printed circuit board 76 is mounted. A suitable audio speaker 35 is provided. The assembled device may be suspended by a suitable flexible lanyard or necklace member 77. In this embodiment, as in all embodiments, it should be appreciated that any number of inputs and or circuit boards may be incorporated as necessary or desired to accomplish desired functions or performance.

Figure 17:
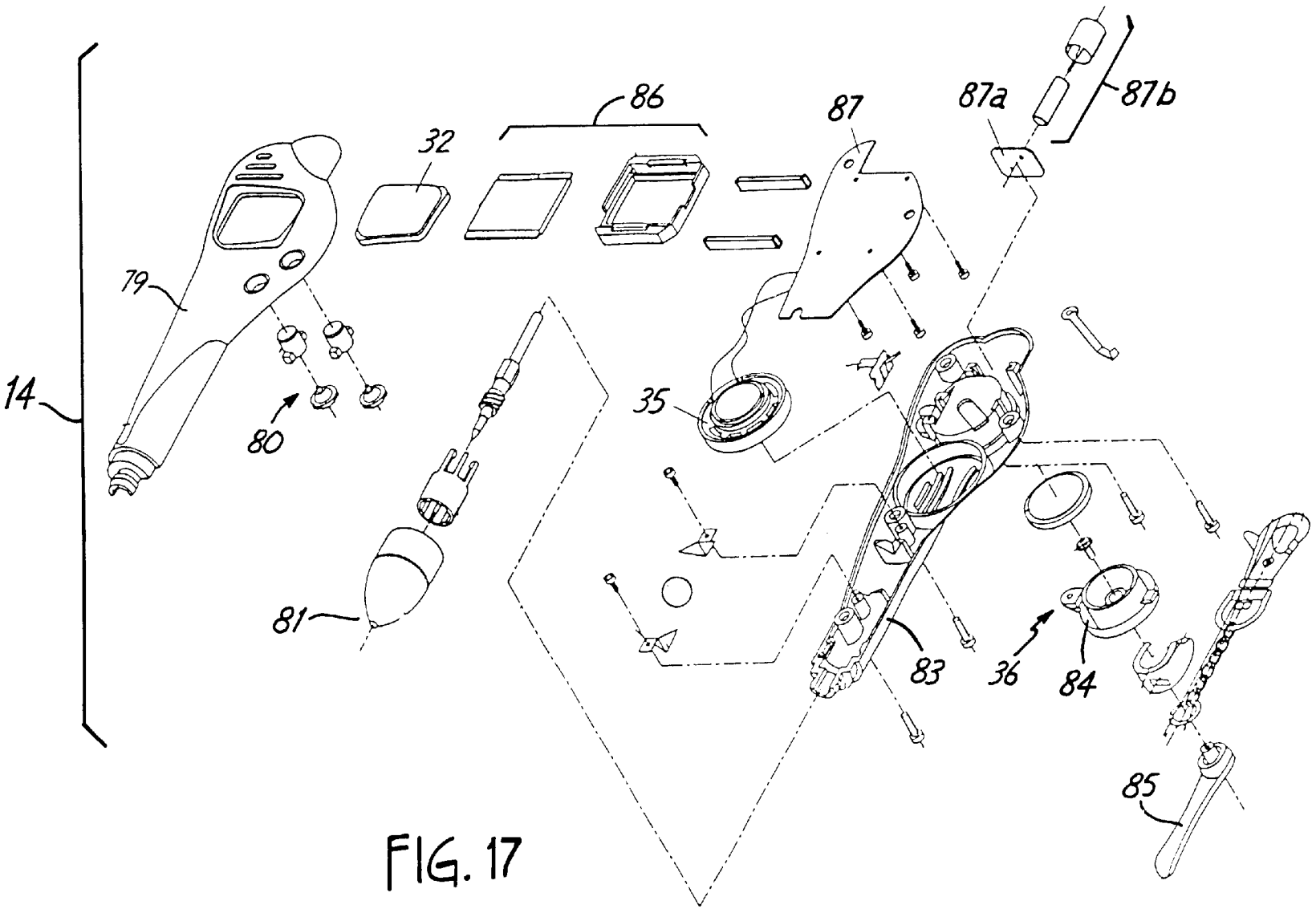
FIG. 17 is an exploded assembly view of another embodiment of the present invention.

FIG. 17 is an exploded assembly depicting another embodiment of the present invention wherein it takes the form of a pen or other writing instrument. This embodiment comprises a first pen case member 79 with openings for operably receiving suitable control inputs or input assemblies such as buttons 80. An ink assembly 81 is provided and includes a pen tip, ball and ink assembly. A second pen case member 83 is provided for attachment to the first case member 79 to form a housing. A battery or battery assembly 36 is received in the housing and covered by a battery cover 84. A lens 32, similar to those described above is received in the housing, occupying a display opening therein, as is an LCD or other suitable display, and a support frame, indicated generally at 86. Two programed and/or programmable circuit boards 87, 87*a* are mounted in the housing, as is a speaker 35. Board 87*a* operably handles input and/or output relative to a gravity switch assembly 87*b* which may be provided for actuating an unprompted reaction, e.g., a sound or animation, based on the orientation or position of the device 14. The operable components, for example, the inputs, circuit boards, LCD, speaker and battery, are electrically coupled by suitable inputs, contacts and connectors.

The embodiments of the amusement device of the present invention include a suitable data and control operating or processing system or systems, typically in the form of a computer or one or more microprocessor boards or chips (for example, integrated circuits 34 or printed circuit boards 87) contained within the housing or case of the various embodiments of the device. These printed circuit boards or chips may be configured as desired and convenient for particular embodiments and functions, and may be constructed and located as suitable for particular embodiments.

Figure 18:
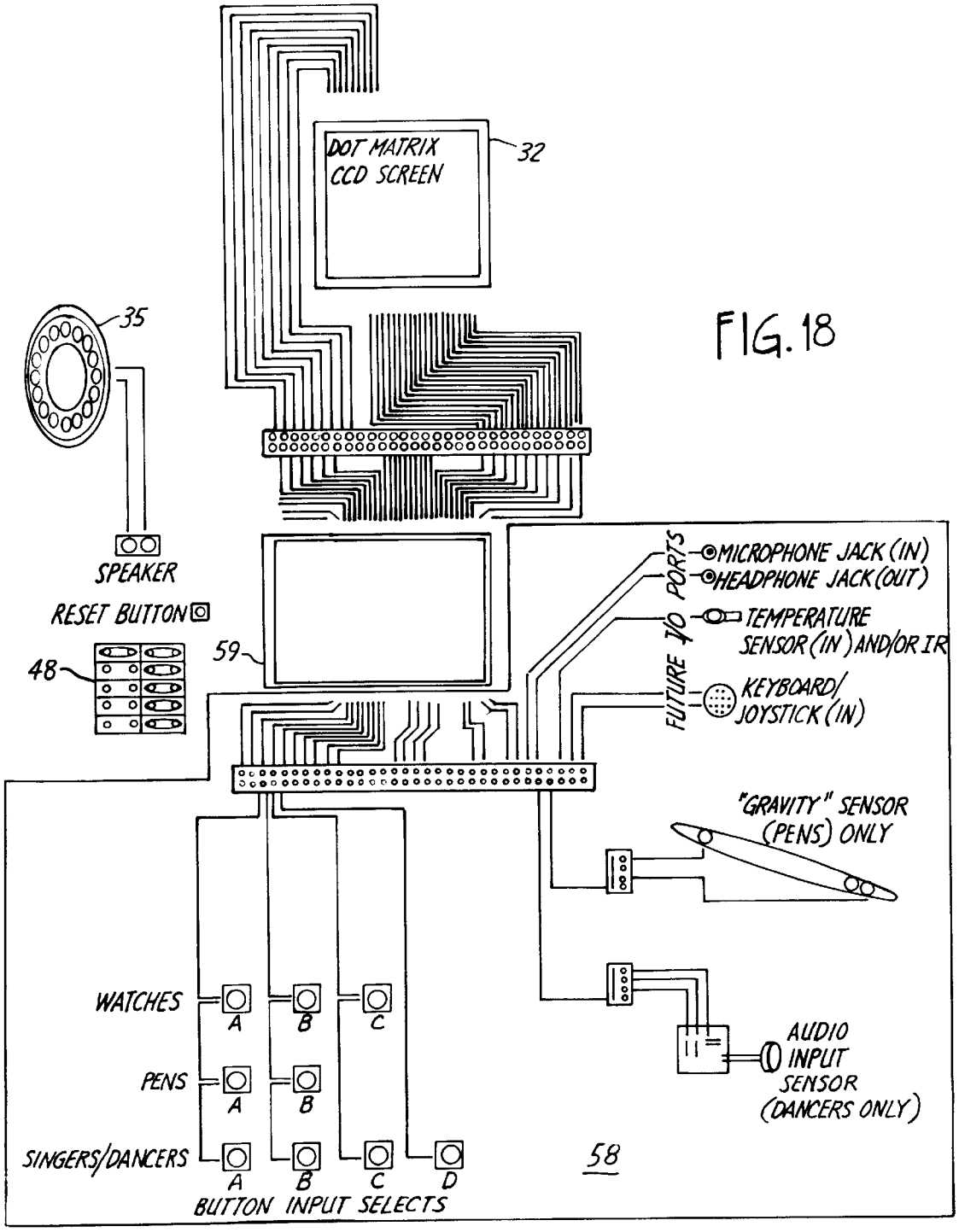
FIG. 18 depicts one embodiment of a representative, exemplary electronic control system, comprising a microprocessor or computer controller, for use in embodiments of the present invention.

FIG. 18 depicts one representative selection and arrangement of the electronics or electronic circuitry and related components which may be used in embodiments of the invention. A plurality of selected inputs 58 (e.g., buttons, gravity sensor/switch, keyboard or joystick, temperature sensor and/or microphones) are operably connected to a microprocessor 59, as are a plurality of selected outputs, in this embodiment, an LCD screen 32 and speaker 35. A reset key or button 48 (or keys or buttons) may also be coupled to the microprocessor 59. In this embodiment, the microprocessor contains the LCD screen driver and the digital audio all in or on one chip. Future performance needs and features (e.g., LCD controller(s), audio enhancements, RAM, etc.) may involve the use of multi-chip sets. For example, and the number and arrangement of chips or pc boards is not limited to this example, the audio may reside on one chip and the LCD screen may be driven by, for example, three other chips with a fourth chip being the controller for issuing commands to the other three chips.

Figure 19:
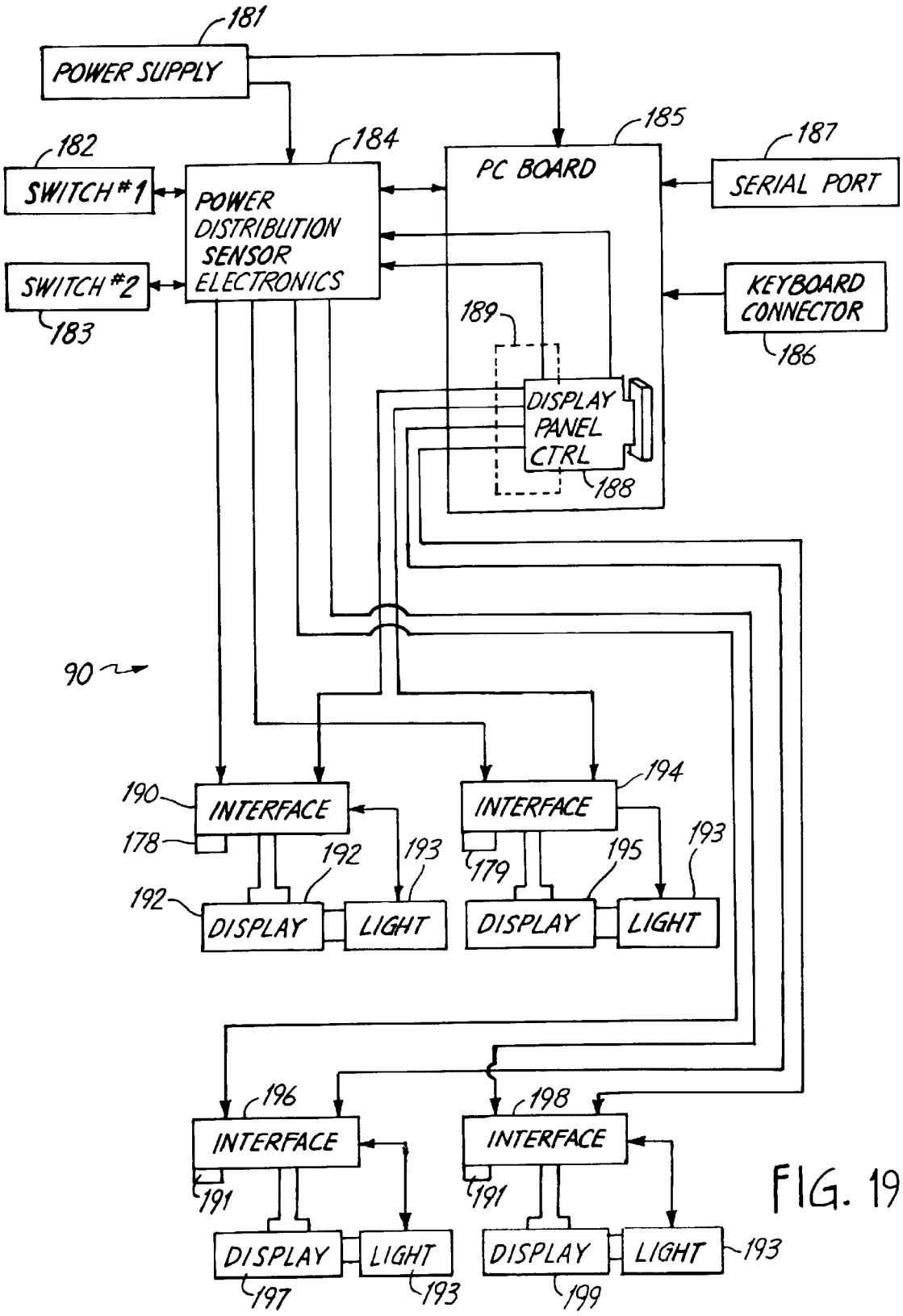
FIG. 19 depicts another embodiment of a representative, exemplary electronic control system, comprising a microprocessor or computer controller, for use in embodiments of the present invention.

FIG. 19 depicts another representative selection and arrangement of the electronics or electronic circuitry and related components which may be used in embodiments of the invention. The depicted control and data processing system 90 includes a suitable power supply 181, typically a battery or a direct current supply of a suitable voltage (e.g., the battery or battery assemblies 36), but other power supplies, such as solar cells, may be used or incorporated as well. Power is supplied to a power distribution and sensor electronics control circuit 184. Control circuit 184 can be one of several commercially available power switching and control circuits, and may be provided in the form of a circuit or circuit board which is detachable, and plugs into a main board or chip 185 or a suitable expansion slot board receptacle.

Power control circuit 184 may be connected to a first input control switch 182 and a second input control switch 183, or to as many switches as are desired or necessary. The switches may be operated by inputs such as inputs 21, 22 23, 24, provided on the housings of the various embodiments of the present invention. In one embodiment, for example, one switch may control powering up the system, and the second switch may control activation of aspects of the programs or modes of operation. There may be one or more additional switches, buttons or inputs, or functions may be combined in a button by the selective operation thereof, and the system 90 can include default settings or subroutines.

FIG. 19 also depicts a controller board, circuit or chip 185 which includes a central microprocessor (not shown) and related components well-known in the industry as computers or printed circuit boards, for example, four or eight bit microprocessors such as those made and offered for sale by Elan Microelectronics Corporation and others, and related memory (not specifically shown). A variety of different configurations and types of memory devices can be connected to a suitable pc or board as is well-known in the art. A panel display control board 188, and/or an optional second such board 189 (shown in phantom), is included. The board 188 typically would be connected or operably coupled to the board 185, for example in expansion slots of circuit board 185. Display control board 188 is capable of controlling the images displayed and other operational parameters of the video and/or audio displays used in the present invention More specifically, the display control board 188 is connected to one or more user interface circuits 196, which show the display station. Additionally, the display control board 188 is shown connected to the additional display interface circuits 190, 194, 198. This arrangement allows the display control board or circuits 188 to provide necessary image display data to suitable electronic driver circuit 197 used to drive the display station or stations (this flow may operate the opposite way, too, i.e., the display control board 188 may receive information or data from the driver circuits). This arrangement also allows the display control boards to provide necessary image display data to additional display electronic drive circuits 192, 195, 199 associated with the displays. The display electronic drive circuits just described may have associated back lights (or other suitable enhancements) 193.

The circuit board 185 may include a serial port 187 to allow data to be programmed or downloaded. This allows performance data to be analyzed in various ways using added detail, or by providing integration with data from other devices so that performance problems can be identified and eliminated. It also allows monitoring of use and accuracy on a routine basis. In some embodiments, performance requirements, user use, responses, performance and/or skill can be varied or manipulated, recorded and displayed, or downloaded.

FIG. 19 further depicts that a keyboard connection port 186 may be provided to couple the pc or microprocessor of the present invention to a larger format microprocessor or computer and keyboard (not shown) to facilitate use, programming and servicing of the system 90. It also shows a number of optional sensor interface connections 191 or control input interfaces 178, 179 for sensing of ambient conditions or direct input through the use of inputs (such as buttons 21, 22, 23, 24) or the like.

The processor or controller 90, whatever form it takes, includes software or programming which is used in the operation of the interactive use of the present invention. It should be understood that the particular software used may vary dependent upon, for example, the desired input and output options and/or interactivity, e.g., the character or characters displayed and the activities of the displayed character(s). The system for some embodiments described herein is being used for a "happy face" character, and so description in that context may be provided as exemplary. However, other characters and activities can be selected and there may be modifications to the software and program routines to accomplish these changes, or such may be required in connection with the wide variety of functions, characters, displays and sounds available.

The processor 90 includes suitable operational modules for performing a number of data processing function in connection with the selected and preferred characters. One function is receiving user input and translating it into a selected action of the display. Other representative functions include, but are not limited to, producing and/or controlling an audio output, both or selectively in response to a sensed ambient condition or stimulus or in response to user input, producing and/or displaying audio and/ or visual inquiries of the user and sensing functions. Such functions and others, including variations thereof, for various embodiments of an interactive digital amusement device in accordance with the present invention are indicated, described and illustrated herein, particularly in the exemplary operational flows depicted in FIGS. 20–23.

Turning then to FIGS. 20–23, these flow diagrams illustrate functions that may be implemented in software or firmware for execution in embodiments of the present invention by a suitable processor or control circuit 90. Upon execution of the functions, processor 90 responds to input by a user to control, for example, a visual output on a display and/or an audio output through an audio output device such as a speaker 35, and provide interaction with the user. The device, including a processor circuit 90 and associated electronics, may be embodied within a watch or a pendant, or other types of enclosures.

Figure 20:
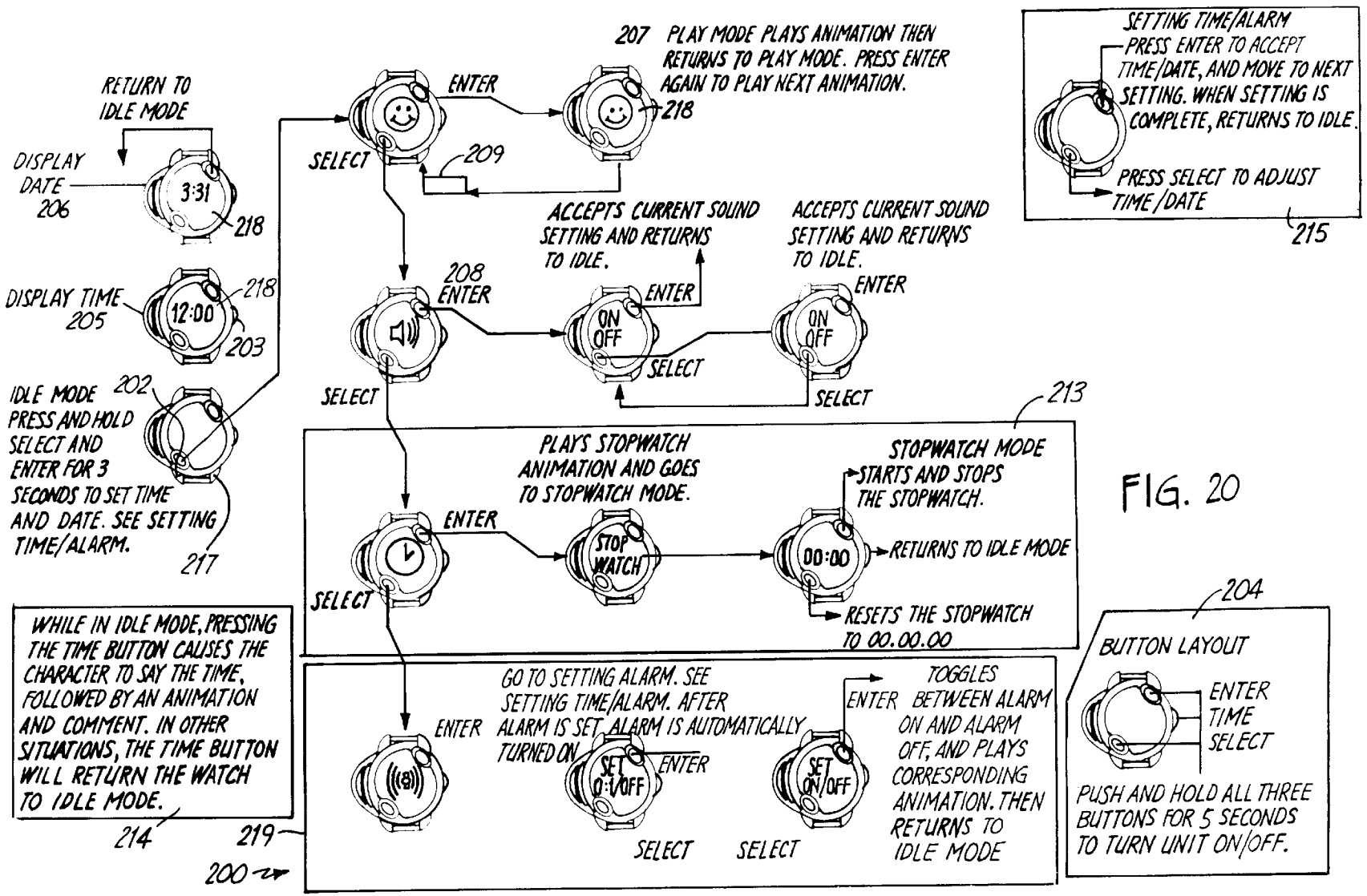
FIG. 20 is a flow diagram illustrating operation of one embodiment of an interactive, substantially digital amusement device in accordance with the present invention.

FIG. 20 is a flow diagram 200 illustration operation of another embodiment of an interactive digital amusement device 217. Device 217 includes a display 218, typically implemented with an LCD screen. The user may interact with device 217 by manipulating an input device, such as buttons 201, 202 and 203. In particular, a user selects one or more of the buttons by depressing them to activate a switch. Other types of input devices may be used, such as touch-sensitive elements, voice activation, infra-red, as well as downloadable devices for devices with changeable programming.

As shown in flow diagram 200, a user may turn device 217 on or off by selecting and holding buttons 201 and 202, and button 203, simultaneously for five seconds, for example (step 204). Device 217 may alternatively include a separate on/off switch or button. Upon turning on device 217, it enters an idle mode 214. A user may manipulate buttons 201 and 202 (and/or other inputs, as necessary or desired) while device 217 is in idle mode 214 in order to operate device 217 in different modes. Upon selecting button 201, for example, device 217 may enter a time display mode 205 in which a time is displayed on display 218. Upon selecting button 201, for example, while in time display mode 205, device 217 may enter a date display mode 206 in which a date is displayed on display 218, which may include a month and day as shown, as well as other types of date or day information. While in time mode 205 or date display mode 206, the user may set a displayed time and date by simultaneously selecting buttons 201, 202 in order to activate a set time/date mode 215. As shown in mode 215, a user may set the time and date by selecting one of the buttons to increment a current digit and select in order to move the display to the next digit in order to set that digit and to save the settings after selection of a last digit. A current digit may be indicated by blinking the digit.

While in the idle mode 214, or other mode, a user may select a button in order to activate a play mode 207 and view an animation on display 218. While in play mode 207, a user may select a button in order to play the next animation (step 209). While in play mode 207, an animation is displayed on display 218, and selection of one of the input buttons, for example, button 202 repeatedly causes a series of animations to be displayed on display 218 in step 209. The animations may be displayed in a particular order upon repeated selection of a button or in a self-prompting random order without further input or prompting from the user. The animations may include a graphical display, and they may be accompanied by an audio output, such as music or speech.

While in any mode 207, a user may select or press a button, button 201, for example, in order to activate the idle sound and/or display setting mode 214. In idle mode 214, a user may select a button, for example button 202, in order to activate or deactivate the audio output. In particular, selection of an appropriate button may change the sound setting between on and off, as may be indicated on display 218, and selection of another button may save the current setting. While in any of its modes, e.g., modes 205, 213, 219, if no button is selected within five seconds, for example, device 217 returns to idle mode 214 and/or a standard, default, ready or "screensaver" display. Alternatively, the device 217 may be configured to remain in a selected mode and only return to idle mode 214 upon selection of a particular button or combination of the buttons.

While in idle mode 214, the user may select one or more of the button inputs in order to activate a stop watch function, animation or message 213. For example, selection of button 202 may cause activation of the stop watch function 213, which may be implemented as a series of stored prerecorded audio counting or countdown messages or an incrementing, digital or analog stop watch display. In addition, selection of button 203 may cause activation of an alarm function 219, which may be implemented as a series of prerecorded messages providing advice-type messages, and which may selected or triggered based upon detection of an inputted setting or condition. The alarm functions 219 may be triggered by an ambient condition, such as light or dark, or they may randomly selected. Detection of the ambient condition may occur through use of interfaces 178 and 179, or other appropriate sensors or sensing devices such as thermometers, microphones, motion detectors and the like. Processor 90 may process the detected ambient condition or a selected setting, under software or firmware control, in order to select a particular audio message and/or display. For example, a value of the detected ambient condition may be compared with known values or thresholds associated with particular messages. When the value matches a known value or is within a particular threshold, the message corresponding to that value or threshold may be selected or may be triggered automatically.

FIG. 21 is a flow diagram 300 illustration operation of another embodiment of an interactive digital amusement device 317. Device 317 includes a display 318, typically implemented with an LCD screen. The user may interact with device 317 by manipulating an input device, implemented with buttons 301, 302, and 303. In particular, a user selects one or more of the buttons by depressing them to activate a switch. Other types of input devices may be used, such as touch-sensitive elements or voice activation.

As shown in flow diagram 300, a user may turn device 317 on or off by selecting and holding all three buttons 301, 302, and 303 simultaneously for five seconds, for example (step 316). Device 317 may alternatively include a separate on/off switch or button. Upon turning on device 317, it enters an idle mode 304. A user may manipulate buttons 301, 302, and 303 while device 317 is in idle mode 304 in order to operate device 317 in different modes. Upon selecting button 301, device 317 enters a time display mode 305 in which a time is displayed on display 318. Upon selecting button 301 while in time display mode 305, device 317 enters a date display mode 306 in which a date is displayed on display 318, which may include a month and day as shown or other types of date information. While in time mode 305 or date display mode 306, the user may set a displayed time and date by simultaneously selecting buttons 302 and 303 in order to activate a set time/date mode 315 (step 310). As shown in mode 315, a user may set the time and date by selecting button 301 to increment a current digit and select button 302 in order to move the display to the next digit in order to set that digit and to save the settings after selection of a last digit. A current digit may be indicated by blinking the digit.

While in date display mode 306, a user may select button 301 in order to activate a play mode 307 and view an animation on display 318. While in play mode 307, a user may select button 302 in order to play the next animation (step 309). While in play mode 307, an animation is displayed on display 318, and selection of button 302 repeatedly causes the series of animations to be displayed on display 318 in step 309. The animations may be displayed in a particular order upon repeated selection of button 302 or in a random order. The animations may include a graphical display possibly accompanied by an audio output, such as music or speech.

While in play mode 307, a user may select button 301 in order to activate an idle sound setting mode 308. In mode 308, a user may select button 302 in order to activate or deactivate the audio output. In particular, selection of button 301 changes the sound setting between on and off as indicated on display 318 (step 311), and selection of button 302 saves the current setting (step 312). While in modes 305–308, if no button 301–303 was selected within five seconds, for example, device 317 returns to idle mode 304. Alternatively, device 317 may be configured to remain in a selected mode and only return to idle mode 304 upon selection of a particular button 301–303 or combination of the buttons.

While in idle mode 304, the user may select buttons 302 and 303 in order to activate an audio message. For example, selection of button 302 causes activation of an audio message, referred to as a "magic 8-ball type response" (step 313), which may be implemented as a series of stored prerecorded audio messages selected based upon detection of an ambient condition, or randomly selected, and providing yes/no or other types of messages. In addition, selection of button 303 causes activation of other audio messages, referred to as "fortune" (step 314), which may be implemented as a series of prerecorded messages providing fortune-type or prediction-type messages and selected based upon detection of an ambient condition or randomly selected. Detection of the ambient condition may occur through use of interfaces 178 and 179, as identified in this specification. Processor 90 may process the detected ambient condition, under software or firmware control, in order to select a particular audio message. For example, a value of the detected ambient condition may be compared with known values or thresholds associated with particular messages. When the value matches a known value or is within a particular threshold, the message corresponding to that value or threshold may be selected.

Figure 22:
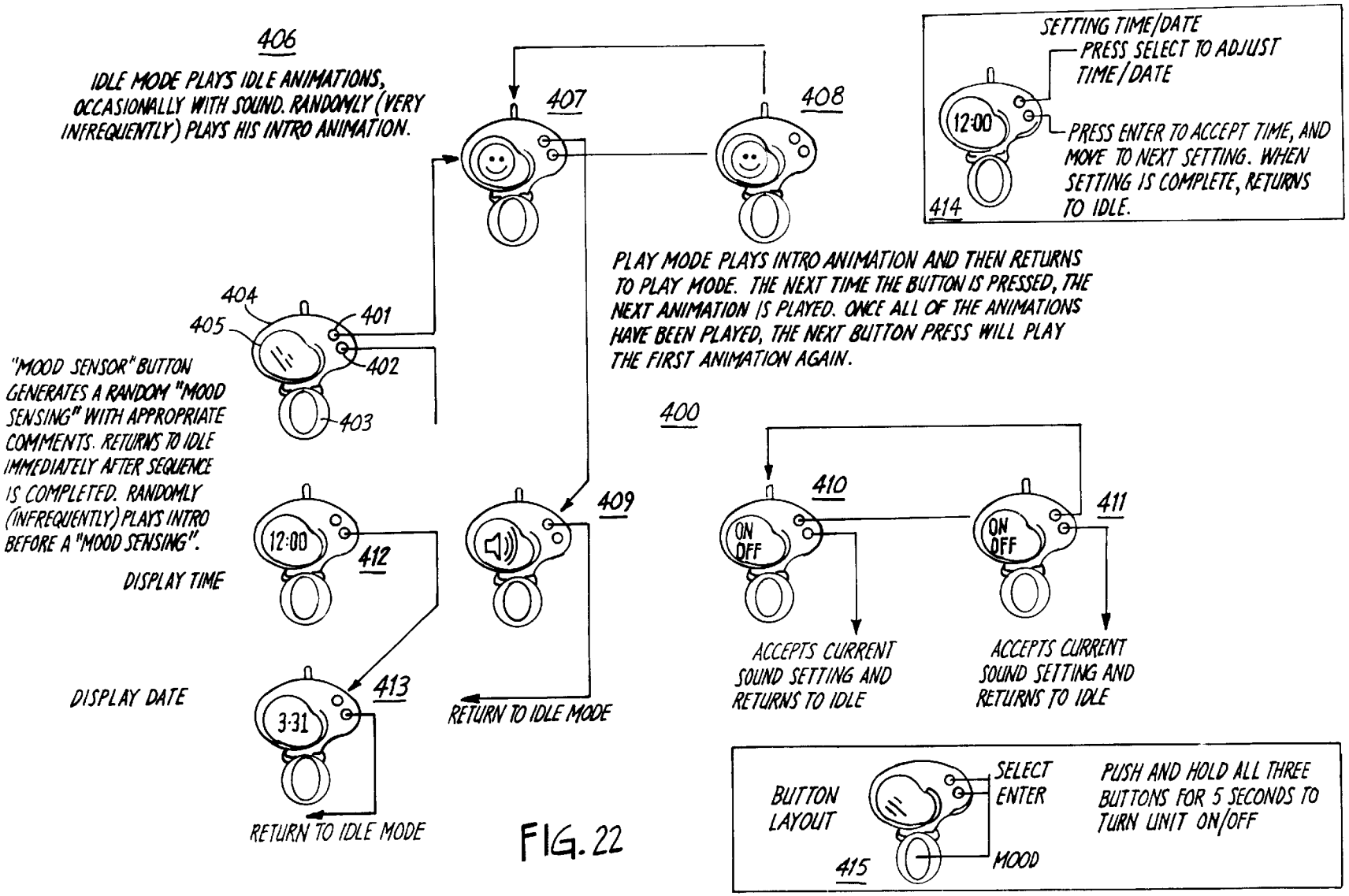
FIG. 22 is a flow diagram illustrating operation of another embodiment of an interactive digital amusement device.

FIG. 22 is a flow diagram 400 illustrating operation of another embodiment of an interactive digital amusement device 404. Device 404 includes a display 405, typically implemented with an LCD display. The user may interact with device 404 by manipulating an input device, implemented with buttons 201, 202, and 203. In particular, a user selects one or more of the buttons by depressing them to activate a switch. Other types of input devices may be used, such as touch-sensitive elements or voice activation.

A user may turn device 404 on and off by simultaneously selecting buttons 401, 402, and 403 for five seconds, for example (step 415). Device 404 may alternatively include a separate on/off switch or button. Upon being turned on or first activated, device 404 enters an idle mode 406. While in idle mode 406, the user may manipulate buttons 401 and 402 in order to activate various modes. For example, selection of button 401 activates a play mode 407 in which an animation is presented on display 405. While in play mode 407, selection of button 402 causes additional animations to be displayed on display 405 (step 408). Therefore, repeated activation of button 402 while in play mode 407 causes activation of a series of stored animations on display 405. The animations may be displayed in a particular order upon repeated selection of button 402 or in a random order. The animations may include a graphical display possibly accompanied by an audio output, such as music or speech.

While in play mode 407, selection of button 401 causes activation of an idle sound setting mode 409 in which a user may activate or deactivate the audio output. While in mode 409, selection of button 402 causes activation of settings modes 410 and 411. In modes 410 and 411, selection of button 401 causes selection of a sound setting in order to turn on or off the sound as indicated on display 405, and selection of button 402 saves the settings and returns to idle mode 406.

While in idle mode 406, selection of button 402 causes activation of a display time mode 412, in which a time is displayed on display 405. While in display time mode 412, selection of button 402 causes activation of a display date mode 413 in which a date is displayed on display 405, which may include a month and day as shown or other types of date information. While in date display mode 413, selection of button 402 returns to idle mode 406. While in display time mode 412 or display date mode 413, the user may set the time and date, as shown in mode 414, by selecting button 401 in order to adjust setting of a current digit, and select button 402 to accept the setting and move the display to the next digit. A current digit may be indicated by blinking the digit.

Also, while in idle mode 406, selection of button 403 generates an audio message, referred to as "mood sensing," with appropriate comments. This message may be implemented with prerecorded audio messages selected based upon detection of an ambient condition or randomly selected. The ambient condition may be sensed using control input interfaces 178 and 179 as identified in this specification. Processor 90 may process the detected ambient condition, under software or firmware control, in order to select a particular audio message. For example, a value of the detected ambient condition may be compared with known values or thresholds associated with particular messages. When the value matches a known value or is within a particular threshold, the message corresponding to that value or threshold may be selected.

Figure 23:
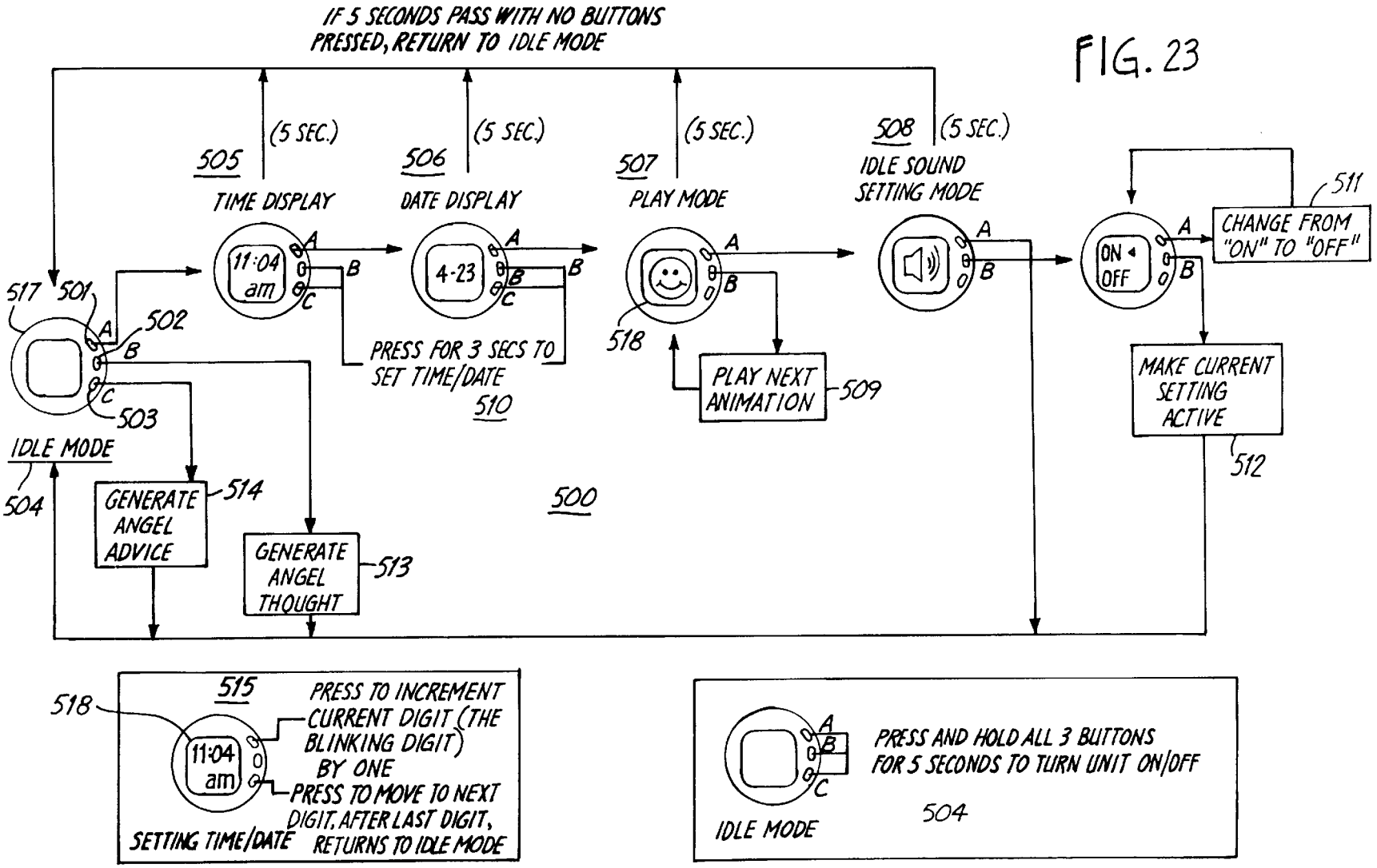
FIG. 23 is a flow diagram illustrating operation of another embodiment of an interactive digital amusement device.

As shown in FIG. 23, flow diagram 500, a user may turn device 517 on or off by selecting and holding all three buttons 501, 502, and 503 simultaneously for five seconds, for example (step 516). Device 517 may alternatively include a separate on/off switch or button. Upon turning on device 517, it enters an idle mode 504. A user may manipulate buttons 501, 502, and 503 while device 517 is in idle mode 504 in order to operate device 517 in different modes. Upon selecting button 501, device 517 enters a time display mode 505 in which a time is displayed on display 518. Upon selecting button 501 while in time display mode 505, device 517 enters a date display mode 506 in which a date is displayed on display 518, which may include a month and day as shown or other types of date information. While in time mode 505 or date display mode 506, the user may set a displayed time and date by simultaneously selecting buttons 502 and 503 in order to activate a set time/date mode 515 (step 510). As shown in mode 515, a user may set the time and date by selecting button 501 to increment a current digit and select button 502 in order to move the display to the next digit in order to set that digit and to save the settings after selection of a last digit. A current digit may be indicated by blinking the digit.

While in date display mode 506, a user may select button 501 in order to activate a play mode 507 and view an animation on display 518. While in play mode 507, a user may select button 502 in order to play the next animation (step 509). While in play mode 507, an animation is displayed on display 518, and selection of button 502 repeatedly causes the series of animations to be displayed on display 518 in step 509. The animations may be displayed in a particular order upon repeated selection of button 502 or in a random order. The animations may include a graphical display possibly accompanied by an audio output, such as music or speech.

While in play mode 507, a user may select button 501 in order to activate an idle sound setting mode 508. In mode 508, a user may select button 502 in order to activate or deactivate the audio output. In particular, selection of button 501 changes the sound setting between on and off as indicated on display 518 (step 511), and selection of button 502 saves the current setting (step 512). While in modes 505–508, if no button 501–503 was selected within five seconds, for example, device 517 returns to idle mode 504. Alternatively, device 517 may be configured to remain in a selected mode and only return to idle mode 504 upon selection of a particular button 501–503 or combination of the buttons.

While in idle mode 504, the user may select buttons 502 and 503 in order to activate an audio message. For example, selection of button 502 causes activation of an audio message, referred to as a "thought" (step 513), which may be implemented as a series of stored prerecorded audio messages selected based upon detection of an ambient condition or randomly selected. In addition, selection of button 503 causes activation of other audio messages, referred to as "advice" (step 514), which may be implemented as a series of prerecorded messages providing advice-type messages and selected based upon detection of an ambient condition or randomly selected. Detection of the ambient condition may occur through use of interfaces 178 and 179, as identified in this specification. Processor 90 may process the detected ambient condition, under software or firmware control, in order to select a particular audio or visual message. For example, a value of the detected ambient condition may be compared with known values or thresholds associated with particular messages. When the value matches a known value or is within a particular threshold, the message corresponding to that value or threshold may be selected.

The preceding examples of embodiments and operational flows are intended to be representative of embodiments of the present invention. The configuration of software or programs for the present invention may be varied in accordance with desired functions. Default displays and messages, e.g., screen-saver type displays or audio messages, may be incorporated, and triggered automatically or selectively. The configurations of the housing and display, the number of inputs and/or the available modes and/or programs of operation may be varied. Luminous or "glow-in-dark" features may be provided, and the various embodiments may include graphics or colors as desired. Thus, the present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A wearable interactive digital amusement device comprising:

a visual display for displaying animated visual images;

an audio component for broadcasting sound;

an audio input for receiving an indication of an ambient sound;

a system memory for storing data including a plurality of animated display images and a plurality of pre-specified sounds;

a processor for controlling the visual display and the audio component, in response to the indication of the ambient sound, to display or broadcast data from the system memory;

a band for securing around a user's wrist; and a housing coupled to the band, the housing containing and securing the visual display, the audio component, the audio input, the system memory, and the processor.

2. The device of claim 1 wherein the housing is rotatably coupled to the band such that the user can rotate the housing with respect to the band.

3. The device of claim 1 further including a second input device capable of manipulation by the user to effect the control system.

4. The device of claim 1 wherein the audio input is a microphone.

5. The device of claim 4 wherein the audio input is adapted to activate the control system to transmit a selected one of the plurality of pre-specified sounds to the audio component.

6. The device of claim 5 wherein the selected pre-specified sound is selected from the group including a mood indication, a thought indication, and an advice indication.

7. The device of claim 3 wherein manipulation of the second input device activates the control system to send a first pre-specified sound to the sound component for broadcasting, the first sound based on the input to the audio input.

8. The device of claim 1 wherein the visual display includes a liquid crystal display.

9. The device of claim 1 further comprising a manual input device having at least one button.

10. The device of claim 9 wherein the processor operates to provide a sequence of visual animations on the visual display in response to manipulation of the manual input device.

11. The device of claim 9 wherein the processor further operates to provide visual time and date information on the visual display in response to manipulation of the manual input device.

12. The device of claim 11 wherein the processor operates to permit a user to set the time and date information in response to manipulation of the manual input device.

13. The device of claim 11 wherein the processor further operates to permit a user to deactivate the audio component in response to manipulation of the manual input device.

14. The device of claim 9 wherein the processor further operates to turn off the visual display in response to manipulation of the manual input device.

* * * * *